US009477185B2

(12) United States Patent
Kosaka et al.

(10) Patent No.: US 9,477,185 B2
(45) Date of Patent: Oct. 25, 2016

(54) HEATER CONTROL UNIT AND IMAGE FORMING APPARATUS

(71) Applicant: Oki Data Corporation, Tokyo (JP)

(72) Inventors: Toru Kosaka, Tokyo (JP); Eiji Wagatsuma, Tokyo (JP); Akira Hagiwara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/830,942

(22) Filed: Aug. 20, 2015

(65) Prior Publication Data

US 2016/0139548 A1 May 19, 2016

(30) Foreign Application Priority Data

Nov. 14, 2014 (JP) ..... 2014-231378

(51) Int. Cl.

*G03G 15/20* (2006.01)
*G03G 15/00* (2006.01)
*H05B 3/00* (2006.01)

(52) U.S. Cl.

CPC ..... *G03G 15/2039* (2013.01); *G03G 15/2042* (2013.01); *G03G 15/2078* (2013.01); *G03G 15/5004* (2013.01); *G03G 15/80* (2013.01); *H05B 3/0014* (2013.01)

(58) Field of Classification Search

CPC ..... G03G 15/2039; G03G 15/2078; G03G 15/80; G03G 15/5004; H05B 3/0014
See application file for complete search history.

(56) References Cited

U.S. PATENT DOCUMENTS 6,292,647 B1 9/2001 Ishida
6,317,571 B1 * 11/2001 Adams ..... G03G 15/2003 399/67
2006/0062585 A1 3/2006 Sone et al.
2007/0230981 A1 * 10/2007 Cho ..... G03G 15/80 399/69
2009/0067867 A1 3/2009 Yamashita et al.
2009/0226202 A1 9/2009 Kinouchi et al.
2011/0090726 A1 * 4/2011 Brotto ..... H02J 7/0065 363/131
2014/0363188 A1 * 12/2014 Akamatsu ..... G03G 15/5004 399/88

FOREIGN PATENT DOCUMENTS

EP 1838138 A1 9/2007
JP 2000242112 A 9/2000
JP 2002124369 A 4/2002
JP 2007199357 A 8/2007
JP 2013-235107 A 11/2013
WO 2004004420 A1 1/2004

OTHER PUBLICATIONS

Kosaka U.S. Appl. No. 14/828,572, filed Aug. 18, 2015.*

* cited by examiner

*Primary Examiner* — Rodney Bonnette
(74) *Attorney, Agent, or Firm* — Panitch Schwarze Belisario & Nadel LLP

(57) ABSTRACT

Provided is a heater controlling unit that includes: a power factor correction circuit configured to convert a first alternating-current voltage supplied from a power supply into a direct-current voltage; an inverter configured to generate a second alternating-current voltage from the direct-current voltage converted by the power factor correction circuit; and a heater to which the second alternating-current voltage generated by the inverter is applied.

21 Claims, 33 Drawing Sheets

| | SIN | DUTY |
|---|---|---|
| 0 | 0.000 | 0.000 |
| 10 | 0.174 | 0.063 |
| 20 | 0.342 | 0.124 |
| 30 | 0.500 | 0.181 |
| 40 | 0643 | 0.232 |
| 50 | 0.766 | 0.277 |
| 60 | 0.866 | 0.313 |
| 70 | 0.940 | 0.340 |
| 80 | 0.985 | 0.356 |
| 90 | 1.000 | 0.362 |
| 100 | 0.985 | 0.356 |
| 110 | 0.940 | 0.340 |
| 120 | 0.866 | 0.313 |
| 130 | 0.766 | 0.277 |
| 140 | 0.643 | 0.232 |
| 150 | 0.500 | 0.181 |
| 160 | 0.342 | 0.124 |
| 170 | 0.174 | 0.063 |
| 180 | 0.000 | 0.000 |
| 190 | 0.174 | 0.063 |
| 200 | 0.342 | 0.124 |
| 210 | 0.500 | 0.181 |
| 220 | 0.643 | 0.232 |
| 230 | 0.766 | 0.277 |
| 240 | 0.866 | 0.313 |
| 250 | 0.940 | 0.340 |
| 260 | 0.985 | 0.356 |
| 270 | 1.000 | 0.362 |
| 280 | 0.985 | 0.356 |
| 290 | 0.940 | 0.340 |
| 300 | 0.866 | 0.313 |
| 310 | 0.766 | 0.277 |
| 320 | 0.643 | 0.232 |
| 330 | 0.500 | 0.181 |
| 340 | 0.342 | 0.124 |
| 350 | 0.174 | 0.063 |

FIG. 11

| | 141V | 70.5V | 35.25V |
|---|---|---|---|
| 0 | 0.000 | 0.000 | 0.000 |
| 10 | 0.063 | 0.031 | 0.016 |
| 20 | 0.124 | 0.062 | 0.031 |
| 30 | 0.181 | 0.090 | 0.045 |
| 40 | 0.232 | 0.116 | 0.058 |
| 50 | 0.277 | 0.138 | 0.069 |
| 60 | 0.313 | 0.157 | 0.078 |
| 70 | 0.340 | 0.170 | 0.085 |
| 80 | 0.356 | 0.178 | 0.089 |
| 90 | 0.362 | 0.181 | 0.090 |
| 100 | 0.356 | 0.178 | 0.089 |
| 110 | 0.340 | 0.170 | 0.085 |
| 120 | 0.313 | 0.157 | 0.078 |
| 130 | 0.277 | 0.138 | 0.069 |
| 140 | 0.232 | 0.116 | 0.058 |
| 150 | 0.181 | 0.090 | 0.045 |
| 160 | 0.124 | 0.062 | 0.031 |
| 170 | 0.063 | 0.031 | 0.016 |
| 180 | 0.000 | 0.000 | 0.000 |
| 190 | 0.063 | 0.031 | 0.016 |
| 200 | 0.124 | 0.062 | 0.031 |
| 210 | 0.181 | 0.090 | 0.045 |
| 220 | 0.232 | 0.116 | 0.058 |
| 230 | 0.277 | 0.138 | 0.069 |
| 240 | 0.313 | 0.157 | 0.078 |
| 250 | 0.340 | 0.170 | 0.085 |
| 260 | 0.356 | 0.178 | 0.089 |
| 270 | 0.362 | 0.181 | 0.090 |
| 280 | 0.356 | 0.178 | 0.089 |
| 290 | 0.340 | 0.170 | 0.085 |
| 300 | 0.313 | 0.157 | 0.078 |
| 310 | 0.277 | 0.138 | 0.069 |
| 320 | 0.232 | 0.116 | 0.058 |
| 330 | 0.181 | 0.090 | 0.045 |
| 340 | 0.124 | 0.062 | 0.031 |
| 350 | 0.063 | 0.031 | 0.016 |

FIG. 13

| | 10ms | 6.67ms | 3.33ms |
|---|---|---|---|
| 0 | 0.000 | 0.000 | 0.000 |
| 10 | 0.063 | 0.094 | 0.181 |
| 20 | 0.124 | 0.181 | 0.313 |
| 30 | 0.181 | 0.256 | 0.362 |
| 40 | 0.232 | 0.313 | 0.313 |
| 50 | 0.277 | 0.349 | 0.181 |
| 60 | 0.313 | 0.362 | 0.000 |
| 70 | 0.340 | 0.349 | 0.000 |
| 80 | 0.356 | 0.313 | 0.000 |
| 90 | 0.362 | 0.256 | 0.000 |
| 100 | 0.356 | 0.181 | 0.000 |
| 110 | 0.340 | 0.094 | 0.000 |
| 120 | 0.313 | 0.000 | 0.000 |
| 130 | 0.277 | 0.000 | 0.000 |
| 140 | 0.232 | 0.000 | 0.000 |
| 150 | 0.181 | 0.000 | 0.000 |
| 160 | 0.124 | 0.000 | 0.000 |
| 170 | 0.063 | 0.000 | 0.000 |
| 180 | 0.000 | 0.000 | 0.000 |
| 190 | 0.063 | 0.094 | 0.181 |
| 200 | 0.124 | 0.181 | 0.313 |
| 210 | 0.181 | 0.256 | 0.362 |
| 220 | 0.232 | 0.313 | 0.313 |
| 230 | 0.277 | 0.349 | 0.181 |
| 240 | 0.313 | 0.362 | 0.000 |
| 250 | 0.340 | 0.349 | 0.000 |
| 260 | 0.356 | 0.313 | 0.000 |
| 270 | 0.362 | 0.256 | 0.000 |
| 280 | 0.356 | 0.181 | 0.000 |
| 290 | 0.340 | 0.094 | 0.000 |
| 300 | 0.313 | 0.000 | 0.000 |
| 310 | 0.277 | 0.000 | 0.000 |
| 320 | 0.232 | 0.000 | 0.000 |
| 330 | 0.181 | 0.000 | 0.000 |
| 340 | 0.124 | 0.000 | 0.000 |
| 350 | 0.063 | 0.000 | 0.000 |

FIG. 17

| | SIN | DUTY |
|---|---|---|
| 0 | 0.000 | 0.000 |
| 10 | 0.174 | 0.063 |
| 20 | 0.342 | 0.124 |
| 30 | 0.500 | 0.181 |
| 40 | 0.643 | 0.232 |
| 50 | 0.766 | 0.277 |
| 60 | 0.866 | 0.313 |
| 70 | 0.940 | 0.340 |
| 80 | 0.985 | 0.356 |
| 90 | 1.000 | 0.362 |
| 100 | 0.985 | 0.356 |
| 110 | 0.940 | 0.340 |
| 120 | 0.866 | 0.313 |
| 130 | 0.766 | 0.277 |
| 140 | 0.643 | 0.232 |
| 150 | 0.500 | 0.181 |
| 160 | 0.342 | 0.124 |
| 170 | 0.174 | 0.063 |
| 180 | 0.000 | 0.000 |
| 190 | 0.174 | 0.063 |
| 200 | 0.342 | 0.124 |
| 210 | 0.500 | 0.181 |
| 220 | 0.643 | 0.232 |
| 230 | 0.766 | 0.277 |
| 240 | 0.866 | 0.313 |
| 250 | 0.940 | 0.340 |
| 260 | 0.985 | 0.356 |
| 270 | 1.000 | 0.362 |
| 280 | 0.985 | 0.356 |
| 290 | 0.940 | 0.340 |
| 300 | 0.866 | 0.313 |
| 310 | 0.766 | 0.277 |
| 320 | 0.643 | 0.232 |
| 330 | 0.500 | 0.181 |
| 340 | 0.342 | 0.124 |
| 350 | 0.174 | 0.063 |

FIG. 25

| | 141V | 100V | 70.5V | 35.25V |
|---|---|---|---|---|
| 0 | 0.000 | 0.000 | 0.000 | 0.000 |
| 10 | 0.063 | 0.045 | 0.031 | 0.016 |
| 20 | 0.124 | 0.088 | 0.062 | 0.031 |
| 30 | 0.181 | 0.128 | 0.090 | 0.045 |
| 40 | 0.232 | 0.165 | 0.116 | 0.058 |
| 50 | 0.277 | 0.196 | 0.138 | 0.069 |
| 60 | 0.313 | 0.222 | 0.157 | 0.078 |
| 70 | 0.340 | 0.241 | 0.170 | 0.085 |
| 80 | 0.356 | 0.253 | 0.178 | 0.089 |
| 90 | 0.362 | 0.256 | 0.181 | 0.090 |
| 100 | 0.356 | 0.253 | 0.178 | 0.089 |
| 110 | 0.340 | 0.241 | 0.170 | 0.085 |
| 120 | 0.313 | 0.222 | 0.157 | 0.078 |
| 130 | 0.277 | 0.196 | 0.138 | 0.069 |
| 140 | 0.232 | 0.165 | 0.116 | 0.058 |
| 150 | 0.181 | 0.128 | 0.090 | 0.045 |
| 160 | 0.124 | 0.088 | 0.062 | 0.031 |
| 170 | 0.063 | 0.045 | 0.031 | 0.016 |
| 180 | 0.000 | 0.000 | 0.000 | 0.000 |
| 190 | 0.063 | 0.045 | 0.031 | 0.016 |
| 200 | 0.124 | 0.088 | 0.062 | 0.031 |
| 210 | 0.181 | 0.128 | 0.090 | 0.045 |
| 220 | 0.232 | 0.165 | 0.116 | 0.058 |
| 230 | 0.277 | 0.196 | 0.138 | 0.069 |
| 240 | 0.313 | 0.222 | 0.157 | 0.078 |
| 250 | 0.340 | 0.241 | 0.170 | 0.085 |
| 260 | 0.356 | 0.253 | 0.178 | 0.089 |
| 270 | 0.362 | 0.256 | 0.181 | 0.090 |
| 280 | 0.356 | 0.253 | 0.178 | 0.089 |
| 290 | 0.340 | 0.241 | 0.170 | 0.085 |
| 300 | 0.313 | 0.222 | 0.157 | 0.078 |
| 310 | 0.277 | 0.196 | 0.138 | 0.069 |
| 320 | 0.232 | 0.165 | 0.116 | 0.058 |
| 330 | 0.181 | 0.128 | 0.090 | 0.045 |
| 340 | 0.124 | 0.088 | 0.062 | 0.031 |
| 350 | 0.063 | 0.045 | 0.031 | 0.016 |

FIG. 26

| | 10ms | 7ms | 3ms |
|---|---|---|---|
| 0 | 0.000 | 0.000 | 0.000 |
| 10 | 0.063 | 0.094 | 0.181 |
| 20 | 0.124 | 0.181 | 0.313 |
| 30 | 0.181 | 0.256 | 0.362 |
| 40 | 0.232 | 0.313 | 0.313 |
| 50 | 0.277 | 0.349 | 0.181 |
| 60 | 0.313 | 0.362 | 0.000 |
| 70 | 0.340 | 0.349 | 0.000 |
| 80 | 0.356 | 0.313 | 0.000 |
| 90 | 0.362 | 0.256 | 0.000 |
| 100 | 0.356 | 0.181 | 0.000 |
| 110 | 0.340 | 0.094 | 0.000 |
| 120 | 0.313 | 0.000 | 0.000 |
| 130 | 0.277 | 0.000 | 0.000 |
| 140 | 0.232 | 0.000 | 0.000 |
| 150 | 0.181 | 0.000 | 0.000 |
| 160 | 0.124 | 0.000 | 0.000 |
| 170 | 0.063 | 0.000 | 0.000 |
| 180 | 0.000 | 0.000 | 0.000 |
| 190 | 0.063 | 0.094 | 0.181 |
| 200 | 0.124 | 0.181 | 0.313 |
| 210 | 0.181 | 0.256 | 0.362 |
| 220 | 0.232 | 0.313 | 0.313 |
| 230 | 0.277 | 0.349 | 0.181 |
| 240 | 0.313 | 0.362 | 0.000 |
| 250 | 0.340 | 0.349 | 0.000 |
| 260 | 0.356 | 0.313 | 0.000 |
| 270 | 0.362 | 0.256 | 0.000 |
| 280 | 0.356 | 0.181 | 0.000 |
| 290 | 0.340 | 0.094 | 0.000 |
| 300 | 0.313 | 0.000 | 0.000 |
| 310 | 0.277 | 0.000 | 0.000 |
| 320 | 0.232 | 0.000 | 0.000 |
| 330 | 0.181 | 0.000 | 0.000 |
| 340 | 0.124 | 0.000 | 0.000 |
| 350 | 0.063 | 0.000 | 0.000 |

FIG. 32

HEATER CONTROL UNIT AND IMAGE FORMING APPARATUS

CROSS REFERENCE TO RELATED APPLICATIONS

This application claims the benefit of Japanese Priority Patent Application JP2014-231378 filed on Nov. 14, 2014, the entire contents of which are incorporated herein by reference.

BACKGROUND

The invention relates to a heater control unit and an image forming apparatus.

An image forming apparatus transfers a toner image formed by an image forming unit onto a medium such as, but not limited to, paper and fixes the transferred toner image onto the medium by a fixing unit. The fixing unit is provided with a heater for performing heating. To control the heating performed by the heater, an existing image forming apparatus controls electric power derived from a commercial power supply with use of a triac. For example, reference is made to Japanese Unexamined Patent Application Publication No. 2013-235107.

SUMMARY

A phase control or a frequency control has to be performed in order to perform a control of electric power with use of a device, including a triac, having an arc-extinguishing property. The phase control involves a poor power factor, and involves a large inrush current applied to a heater as well, resulting in generation of a harmonic current. The frequency control involves a large temperature ripple in the heater, resulting in worsening of a flicker.

It is desirable to suppress generation of one or both of a conduction noise and a flicker.

A heater control unit according to an embodiment of the invention includes: a power factor correction circuit configured to convert a first alternating-current voltage supplied from a power supply into a direct-current voltage; an inverter configured to generate a second alternating-current voltage from the direct-current voltage converted by the power factor correction circuit; and a heater to which the second alternating-current voltage generated by the inverter is applied.

An image forming apparatus according to an embodiment of the invention includes: an image forming unit configured to form a developer image on a medium; and a fixing unit configured to fix the developer image formed on the medium. The fixing unit includes: a power factor correction circuit configured to convert a first alternating-current voltage supplied from a power supply into a direct-current voltage; an inverter configured to generate a second alternating-current voltage from the direct-current voltage converted by the power factor correction circuit; and a heater to which the second alternating-current voltage generated by the inverter is applied.

According to the foregoing embodiments of the invention, it is possible to suppress generation of one or both of a conduction noise and a flicker.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

BRIEF DESCRIPTION OF THE DRAWINGS

FIG. 11 is a table illustrating an example of duty ratios of the respective PWM signals in the first example embodiment.

FIG. 13 is a table illustrating an example of duty ratios corresponding to respective voltages in the first example embodiment.

FIG. 17 is a table illustrating an example of duty ratios of respective PWM signals to be outputted from an inverter controller in the second example embodiment.

FIG. 25 is a table illustrating an example of duty ratios of the respective PWM signals in the third example embodiment.

FIG. 26 is a table illustrating an example of duty ratios corresponding to respective voltages in the third example embodiment.

FIG. 32 is a table illustrating an example of duty ratios of respective PWM signals to be outputted from an inverter controller in the fourth example embodiment.

DETAILED DESCRIPTION

In the following, some example embodiments of the invention are described in detail with reference to the accompanying drawings. Note that the following description is directed to illustrative examples of the invention and not to be construed as limiting to the invention. Also, factors including, without limitation, arrangement, dimensions, and a dimensional ratio of elements illustrated in each drawing are illustrative only and not to be construed as limiting to the invention.

[First Example Embodiment]

[Configuration]

Figure 1:
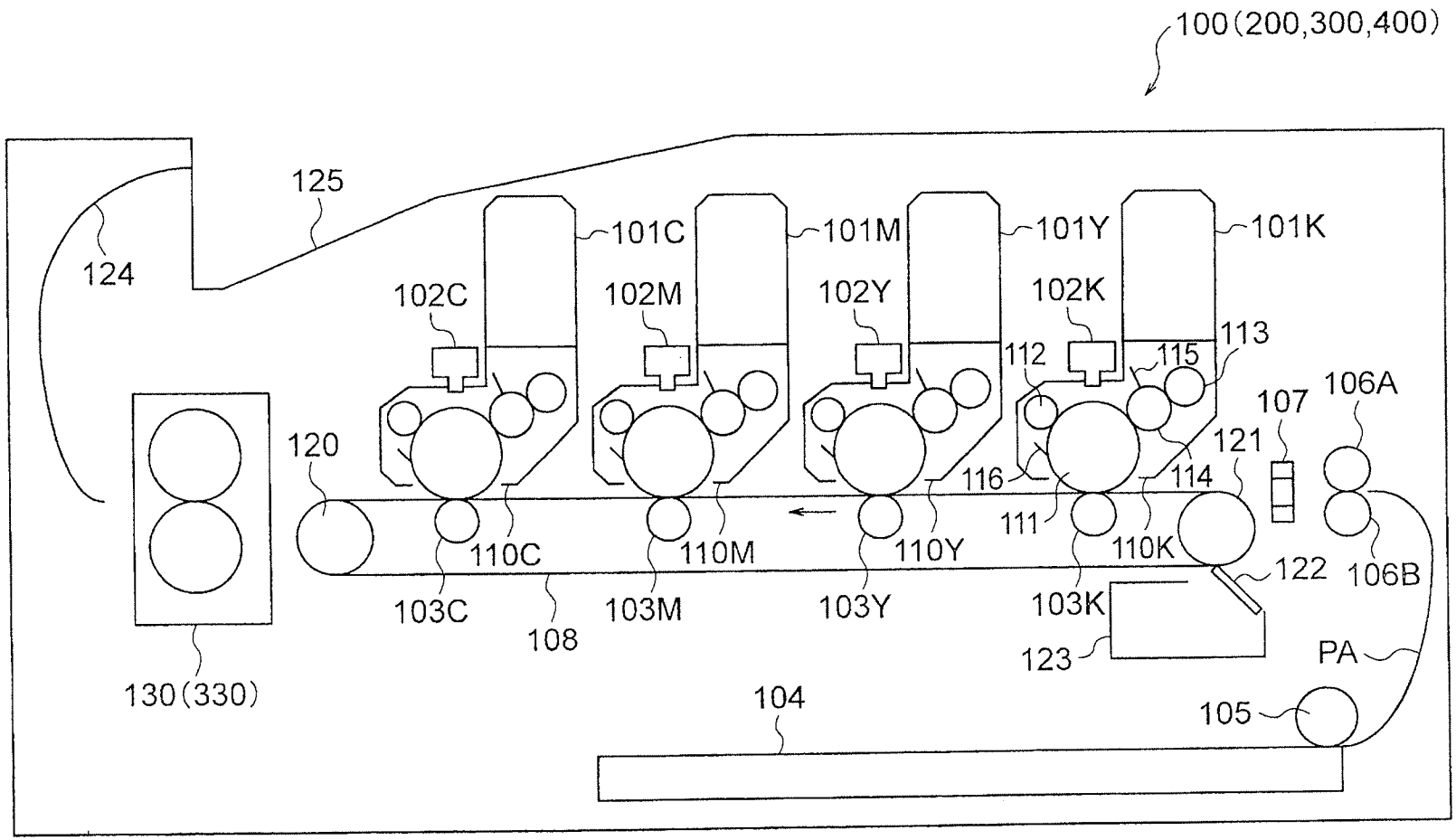
FIG. 1 schematically illustrates a configuration of an image forming apparatus according to any one of first to fourth example embodiments.

FIG. 1 schematically illustrates a configuration of an image forming apparatus 100 according to a first example embodiment.

The image forming apparatus 100 illustrated in FIG. 1 is a color image forming apparatus, although the image forming apparatus 100 may be a monochrome image forming apparatus.

The image forming apparatus 100 may include toner cartridges 101K, 101Y, 101M, and 101C, LED heads 102K, 102Y, 102M, and 102C, development units 110K, 110Y, 110M, and 110C, transfer rollers 103K, 103Y, 103M, and 103C, a medium cassette 104, a hopping roller 105, resist rollers 106A and 106B, a medium detection sensor 107, a transfer belt 108, a driving roller 120, a driven roller 121, a transfer belt cleaning blade 122, a cleaner container 123, a fixing unit 130, a medium guide 124, and a discharge tray 125. The toner cartridges 101K, 101Y, 101M, and 101C may hereinafter be referred to as toner cartridges 101 unless otherwise stated to distinguish them from one another. The LED heads 102K, 102Y, 102M, and 102C may hereinafter be referred to as LED heads 102 unless otherwise stated to distinguish them from one another. The development units 110K, 110Y, 110M, and 110C may hereinafter be referred to as development units 110 unless otherwise stated to distinguish them from one another. The transfer rollers 103K, 103Y, 103M, and 103C may hereinafter be referred to as transfer rollers 103 unless otherwise stated to distinguish them from one another. The resist rollers 106A and 106B may hereinafter be referred to as resist rollers 106 unless otherwise stated to distinguish them from one another. The medium cassette 104 may alternatively be a paper cassette 104. The medium detection sensor 107 may alternatively be a paper detection sensor 107. The medium guide 124 may alternatively be a paper guide 124.

Note that reference signs in parentheses in FIG. 1 denote configurations in second to fourth example embodiments.

The development units 110 each may be an image forming unit that forms a toner image. The toner image may be a developer image.

Each of the development units 110 may include a photoreceptor drum 111, a charge roller 112, a feed roller 113, a development roller 114, a development blade 115, and a cleaning blade 116.

The photoreceptor drum 111 may be evenly charged by the charge roller 112.

The charged photoreceptor drum 111 may be subjected to formation of a latent image by means of emission of light performed by the corresponding LED head 102.

The toner cartridge 101 may be provided attachable to and detachable from the corresponding development unit 110, and stores therein a toner that may be a developer. The toner stored in the toner cartridge 101 may be fed to the development roller 114 by the feed roller 113. The toner fed to the development roller 114 may be formed into an even toner layer by the development blade 115. The toner on the development roller 114 may be attached to the latent image formed on the photoreceptor drum 111, which may form the toner image on a surface of the photoreceptor drum 111.

The cleaning blade 116 cleans the toner remaining on the photoreceptor drum 111.

The medium cassette 104 may store therein a medium PA. The medium PA may be, for example but not limited to, paper.

The hopping roller 105 may convey the medium PA from the medium cassette 104.

The resist roller 106 may convey the medium PA to the transfer belt 108 at appropriate timing.

The medium detection sensor 107 may be a contact medium detection sensor or a contactless medium detection sensor that detects passing of the medium PA.

The transfer belt 108 may be stretched around the driving roller 120 and the driven roller 121.

The driving roller 120 may move the transfer belt 108 by means of driving of a motor to convey the medium PA on the transfer belt 108.

The transfer roller 103 may apply a bias to a transfer nip from the back of the transfer belt 108 to transfer the toner image formed on the photoreceptor drum 111 onto the medium PA.

The transfer belt cleaning blade 122 may be adapted to scrape the toner on the transfer belt 108. The scraped toner may be stored in the cleaner container 123.

The fixing unit 130 may fix the toner image transferred on the medium PA by means of application of heat and pressure.

The medium guide 124 may discharge the medium PA onto the discharge tray 125 with the medium PA facing down.

Figure 2:
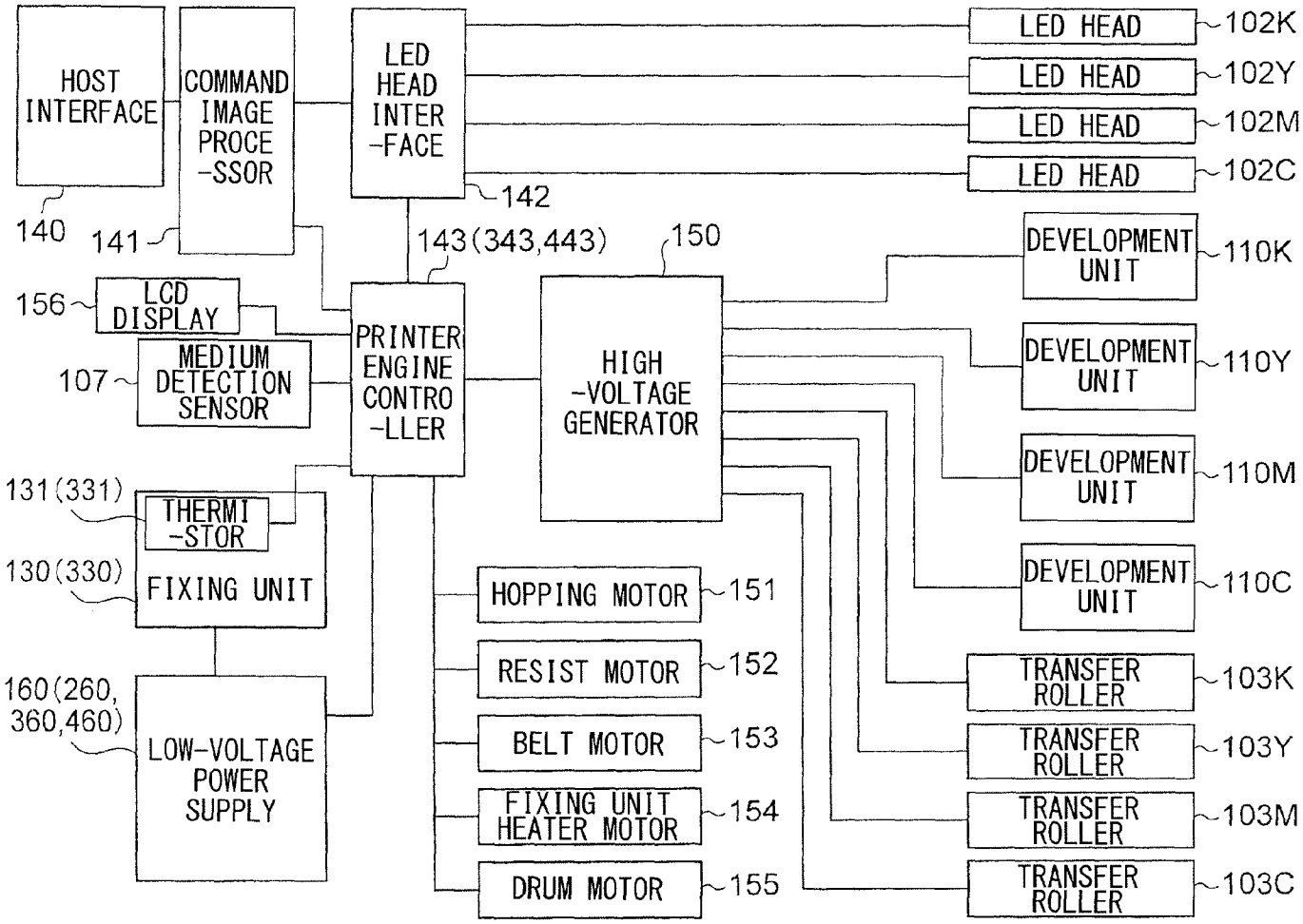
FIG. 2 is a block diagram illustrating a configuration of a control system of the image forming apparatus according to any one of the first to the fourth example embodiments.

FIG. 2 is a block diagram illustrating a configuration of a control system of the image forming apparatus 100.

The control system of the image forming apparatus 100 may include a host interface 140, a command image processor 141, an LED head interface 142, and a printer engine controller 143 that serves as a main controller. Note that reference signs in parentheses denote configurations in the second to fourth example embodiments.

The host interface 140 may send and receive data to and from the command image processor 141.

The command image processor 141 may output image data to the LED head interface 142.

The LED head interface 142 may cause the LED head 102 to emit light, based on a control of a head drive pulse or the like performed by the printer engine controller 143.

The printer engine controller 143 may send a signal to a high-voltage generator 150. The high-voltage generator 150 may generate, based on the signal sent from the printer engine controller 143, a high voltage to apply a bias to each of the development units 110 and each of the transfer rollers 103. The medium detection sensor 107 may be used to adjust timing of generating the transfer bias.

The printer engine controller 143 may drive, at predetermined timing, a hopping motor 151, a resist motor 152, a belt motor 153, a fixing unit heater motor 154, and a drum motor 155. An LCD display 156 may be a display controlled by the printer engine controller 143.

The fixing unit 130 may receive a supply of electric power from a low-voltage power supply 160 that may serve as a power supply unit. A temperature of the fixing unit 130 may be controlled by the printer engine controller 143, based on a detection value derived from a thermistor 131.

Figure 3:
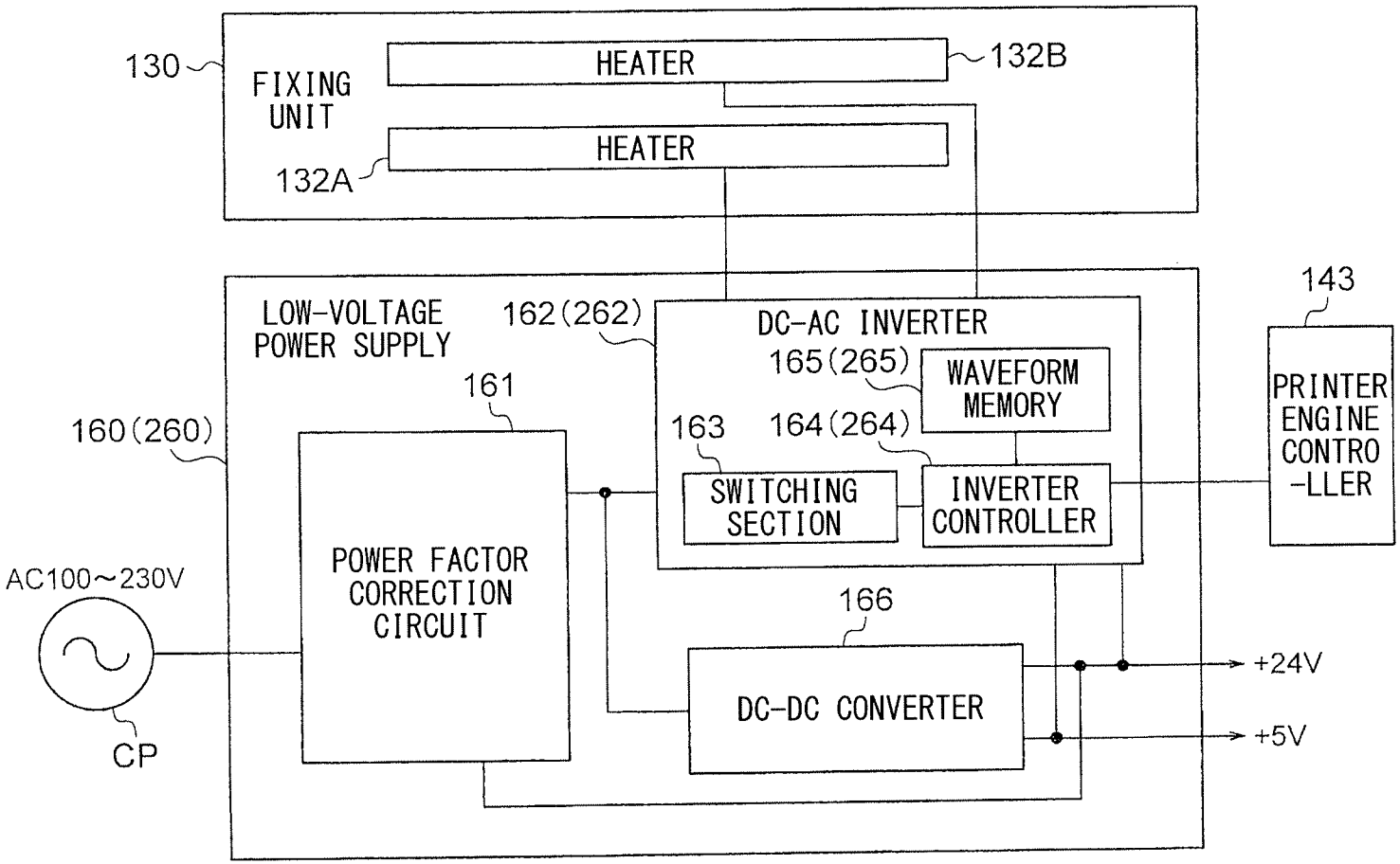
FIG. 3 is a block diagram schematically illustrating a configuration of a low-voltage power supply in the first example embodiment or the second example embodiment.

FIG. 3 is a block diagram schematically illustrating a configuration of the low-voltage power supply 160.

The fixing unit 130 may include two heaters 132A and 132B. The heaters 132A and 132B may hereinafter be referred to as heaters 132 unless otherwise stated to distinguish them from one another. In the present example embodiment, the heaters 132 each may be a halogen heater, although any other heater may be used. As for the thermistor 131 illustrated in FIG. 2, two thermistors may be provided in order to detect temperatures of the two respective heaters 132A and 132B.

The low-voltage power supply 160 may receive an input of an alternating current (AC) in a range from 100 V to 230 V from an external commercial power supply CP.

The low-voltage power supply 160 may include a power factor correction circuit 161, a DC-AC inverter 162, and a DC-DC converter 166. Note that reference signs in parentheses in FIG. 3 each denote a configuration in the second embodiment.

The power factor correction circuit 161 converts a commercial alternating-current voltage into a direct-current voltage, and outputs the converted direct-current voltage. In the present example embodiment, the power factor correction circuit 161 may receive an input of 1500 W, and perform a conversion at efficiency of 95% to perform an output of 1425 W, although the power factor correction circuit 161 is not limited thereto.

The DC-AC inverter 162 is an inverter that converts the direct-current voltage into an alternating-current voltage. The DC-AC inverter 162 may include a switching section 163, an inverter controller 164, and a waveform memory 165. The desired alternating-current voltage following the conversion performed by the DC-AC inverter 162 is applied to each of the heaters 132.

The DC-DC converter 166 may step down the direct-current voltage to generate a different direct-current voltage.

The low-voltage power supply 160, the printer engine controller 143, and the heaters 132 may structure a heater control unit in one embodiment of the invention.

Figure 4:
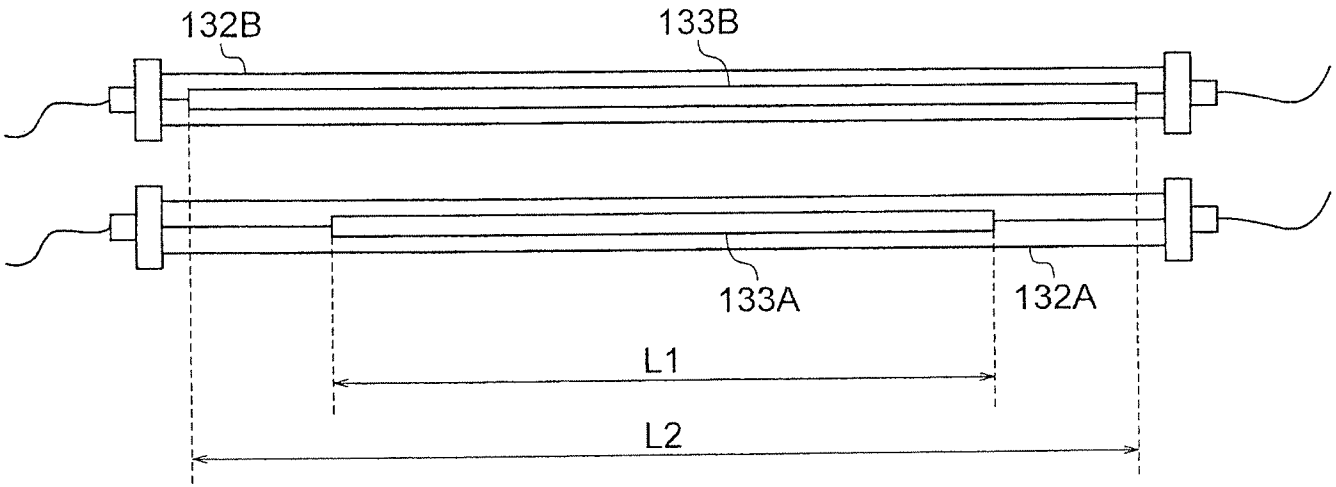
FIG. 4 schematically describes heaters provided in a fixing unit in the first example embodiment.

FIG. 4 schematically describes the heaters 132 provided in the fixing unit 130. The heater 132A may be mounted with a filament 133A. The filament 133A may have a heat generation length L1 corresponding to a width of a longitudinally-fed medium that may have a size of A4. In the present example embodiment, the heater 132A may have an output of 700 W, although the heater 132A is not limited thereto.

The heater 132B may be mounted with a filament 133B. The filament 133B may have a heat generation length L2 corresponding to a width of a longitudinally-fed medium that may have a size of A3. In the present example embodiment, the heater 132B may have an output of 1000 W, although the heater 132B is not limited thereto.

Figure 5:
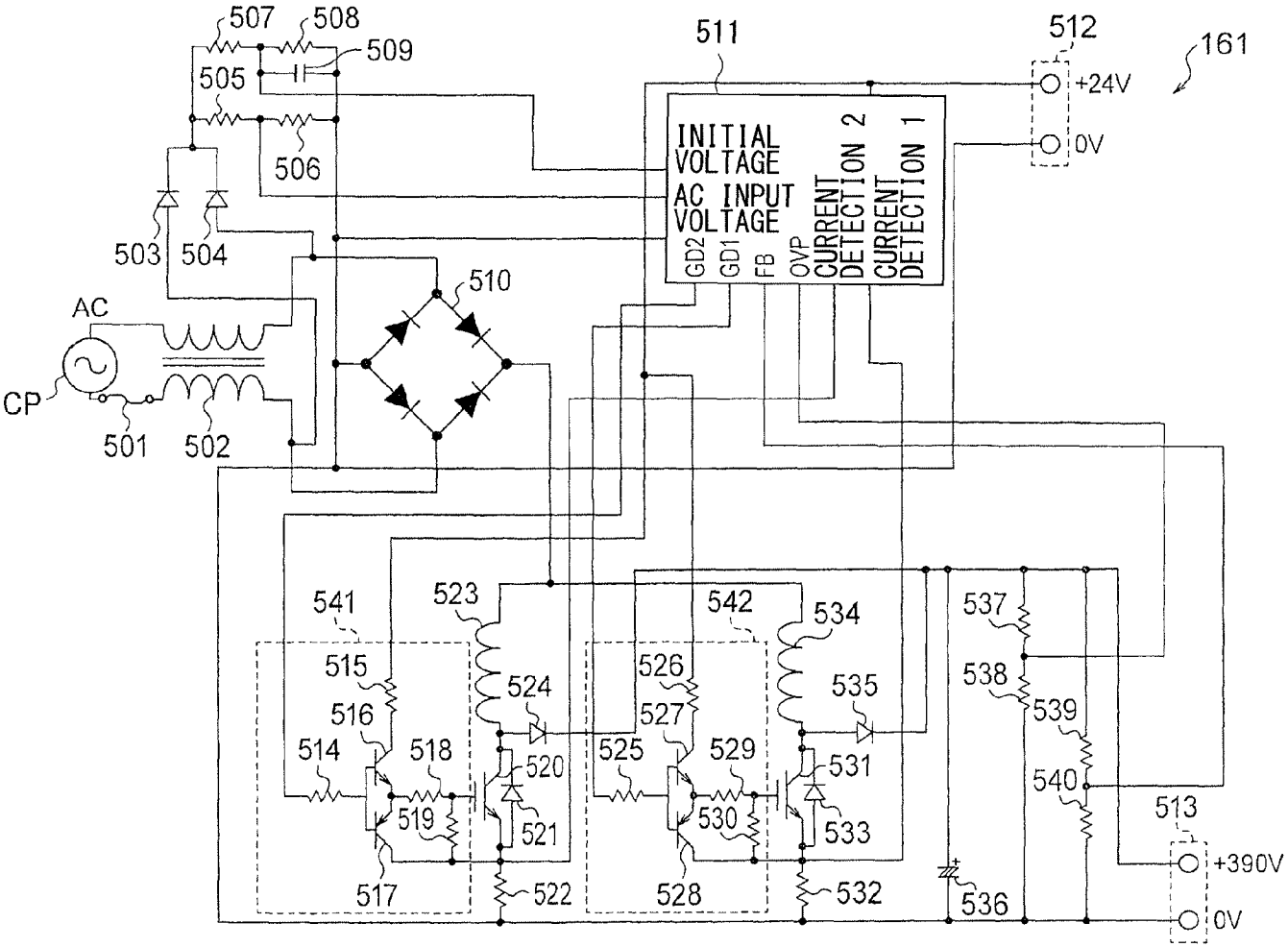
FIG. 5 is a circuit diagram illustrating a power factor correction circuit in the first example embodiment.

FIG. 5 is a circuit diagram illustrating the power factor correction circuit 161.

A reference numeral 501 may denote a fuse. A reference numeral 502 may denote a common-mode choke coil. Reference numerals 503 and 504 each may denote a diode. Reference numerals 505, 506, 507, and 508 each may denote a resistor. A reference numeral 509 may denote a capacitor. A reference numeral 510 may denote a bridge diode. A reference numeral 511 may denote a power factor correction (PFC) control integrated circuit (IC). A reference numeral 512 may denote a direct-current (DC) 24 V power supply input section. A reference numeral 513 may denote a DC 390 V power supply output section. Reference numerals 514 and 515 each may denote a resistor. A reference numeral 516 may denote an NPN transistor. A reference numeral 517 may denote a PNP transistor. Reference numerals 518 and 519 each may denote a resistor. A reference numeral 520 may denote an insulated-gate bipolar transistor (IGBT). A reference numeral 521 may denote a diode. A reference numeral 522 may denote a current detecting resistor. A reference numeral 523 may denote an inductor. A reference numeral 524 may denote a diode. Reference numerals 525 and 526 each may denote a resistor. A reference numeral 527 may denote an NPN transistor. A reference numeral 528 may denote a PNP transistor. Reference numerals 529 and 530 each may denote a resistor. A reference numeral 531 may denote an IGBT. A reference numeral 532 may denote a current detecting resistor. A reference numeral 533 may denote a diode. A reference numeral 534 may denote an inductor. A reference numeral 535 may denote a diode. A reference numeral 536 may denote an electrolytic capacitor. Reference numerals 537, 538, 539, and 540 each may denote a resistor. Reference numerals 541 and 542 each may denote a gate drive circuit block that may be configured by the resistors and the transistor.

The PFC control IC 511 in the power factor correction circuit 161 in the present example embodiment may be adapted to accept an input in a predetermined voltage range ranging, without limitation, from AC 100 V to AC 230 V, making it possible for the power factor correction circuit 161 to support a so-called universal input.

Figure 6:
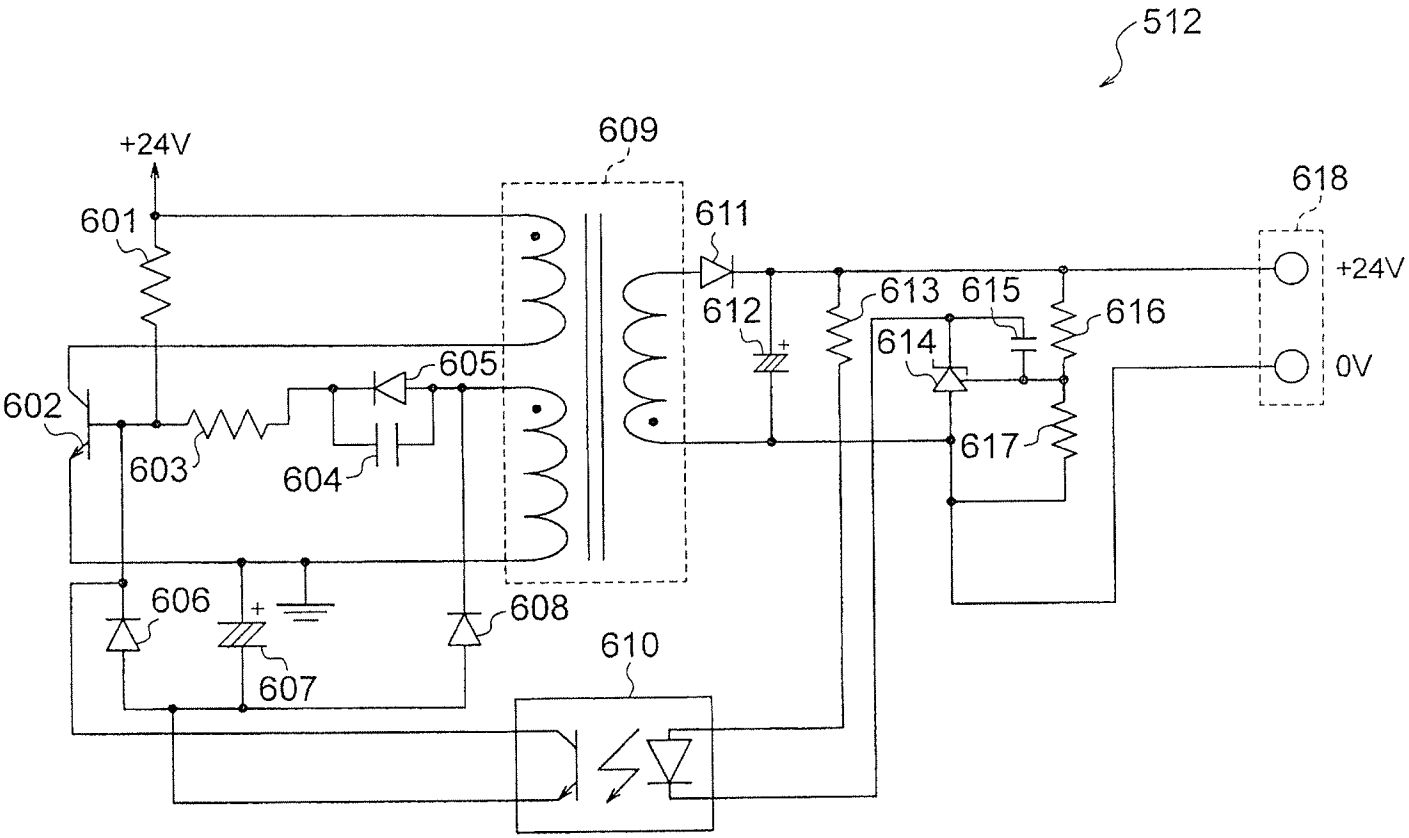
FIG. 6 is a circuit diagram illustrating a DC 24 V power supply input section in the first example embodiment.

FIG. 6 is a circuit diagram illustrating the DC 24 V power supply input section 512.

The DC 24 V power supply input section 512 may be a DC-DC converter in which isolation is provided by a transformer. Note that the DC-AC inverter 162 may have a power supply having a configuration similar to the configuration of the DC 24 V power supply input section 512.

A reference numeral 601 may denote a resistor. A reference numeral 602 may denote an NPN transistor. A reference numeral 603 may denote a resistor. A reference numeral 604 may denote a capacitor. Reference numerals 605 and 606 each may denote a diode. A reference numeral 607 may denote an electrolytic capacitor. A reference numeral 608 may denote a diode. A reference numeral 609 may denote a transformer. A reference numeral 610 may denote a photo coupler. A reference numeral 611 may denote a diode. A reference numeral 612 may denote an electrolytic capacitor. A reference numeral 613 may denote a resistor. A reference numeral 614 may denote a shunt regulator for, such as, but not limited to, TL431. A reference numeral 615 may denote a capacitor. Reference numerals 616 and 617 each may denote a resistor. A reference numeral 618 may denote a DC 24 V power supply output section.

Figure 7:
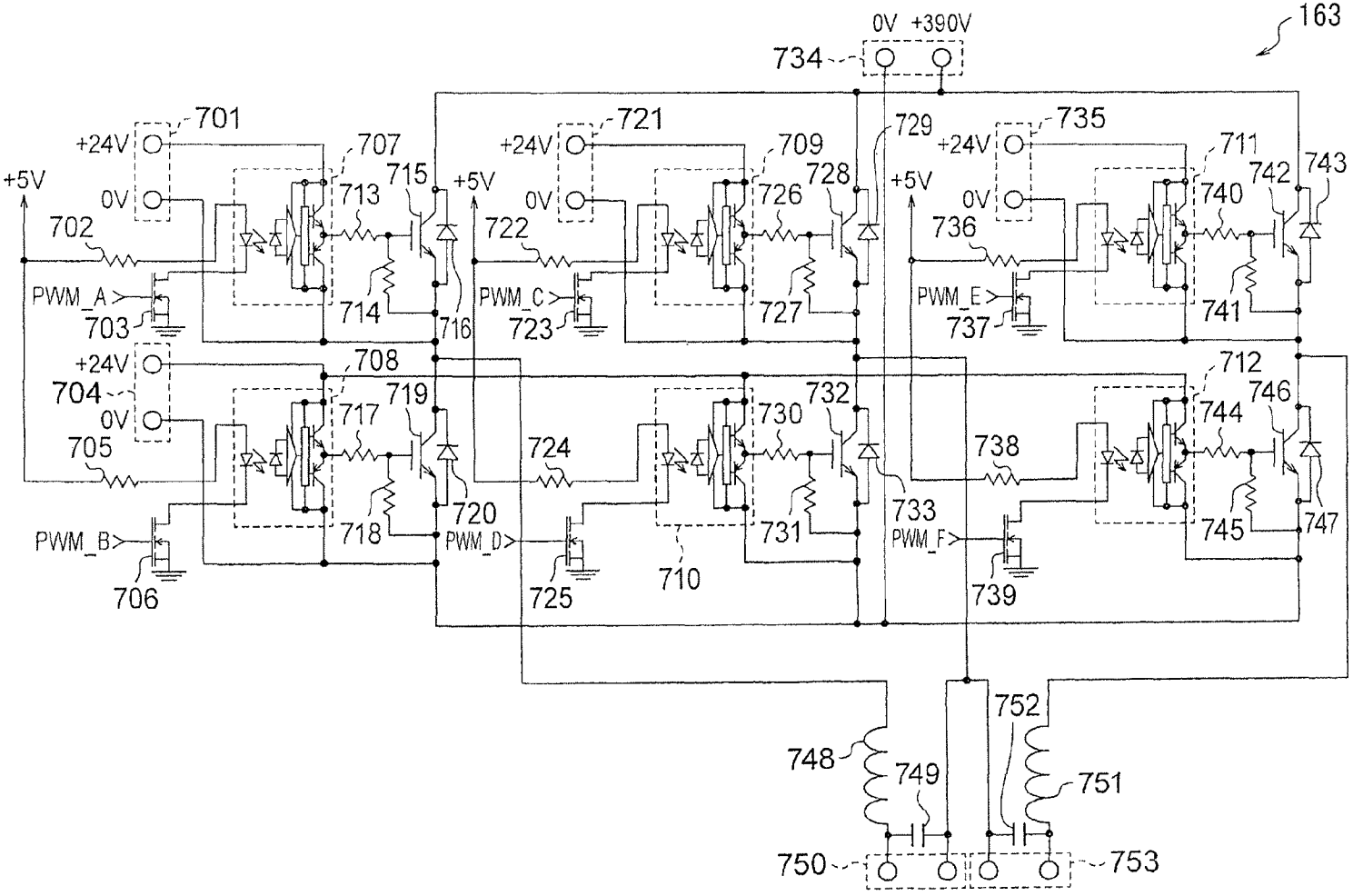
FIG. 7 is a circuit diagram illustrating a switching section of a DC-AC inverter in the first example embodiment.

FIG. 7 is a circuit diagram illustrating the switching section 163 of the DC-AC inverter 162.

The DC-AC inverter 162 may be controlled in switching timing by pulse width modulation (PWM) signals outputted from the inverter controller 164 to be described later in detail.

A reference numeral 701 may denote a DC 24 V power supply input section. A reference numeral 702 may denote a resistor. A reference numeral 703 may denote an N-channel FET. A reference numeral 704 may denote a DC 24 V power supply input section. A reference numeral 705 may denote a resistor. A reference numeral 706 may denote an N-channel FET. Reference numerals 707, 708, 709, 710, 711, and 712 each may denote a photo coupler such as, but not limited to, TLP251. Reference numerals 713 and 714 each may denote a resistor. A reference numeral 715 may denote an IGBT. A reference numeral 716 may denote a diode. Reference numerals 717 and 718 each may denote a resistor. A reference numeral 719 may denote an IGBT. A reference numeral 720 may denote a diode. A reference numeral 721 may denote a DC 24 V power supply input section. A reference numeral 722 may denote a resistor. A reference numeral 723 may denote an N-channel FET. A reference numeral 724 may denote a resistor. A reference numeral 725 may denote an N-channel FET. Reference numerals 726 and 727 each may denote a resistor. A reference numeral 728 may denote an IGBT. A reference numeral 729 may denote a diode. Reference numerals 730 and 731 each may denote a resistor. A reference numeral 732 may denote an IGBT. A reference numeral 733 may denote a diode. A reference numeral 734 may denote a DC 390 V power supply input section. A reference numeral 735 may denote a DC 24 V power supply input section. A reference numeral 736 may denote a resistor. A reference numeral 737 may denote an N-channel FET. A reference numeral 738 may denote a resistor. A reference numeral 739 may denote an N-channel FET. Reference numerals 740 and 741 each may denote a resistor. A reference numeral 742 may denote an IGBT. A reference numeral 743 may denote a diode. Reference numerals 744 and 745 each may denote a resistor. A reference numeral 746 may denote an IGBT. A reference numeral 747 may denote a diode. A reference numeral 748 may denote an inductor. A reference numeral 749 may denote a capacitor. A reference numeral 750 may denote an inverter output section. A reference numeral 751 may denote an inductor. A reference numeral 752 may denote a capacitor. A reference numeral 753 may denote an inverter output section. The DC-AC inverter 162 may include the plurality of inverter output sections 750 and 753. The inverter output sections 750 and 753 may have respective outputs coupled to the heaters 132.

Figure 8:
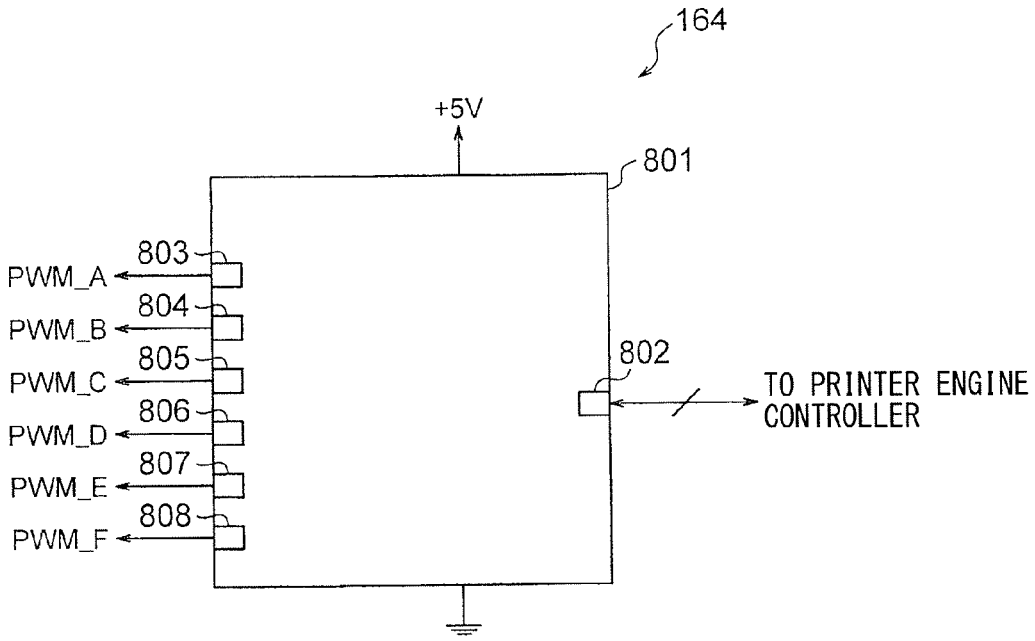
FIG. 8 is a circuit diagram illustrating an inverter controller of the DC-AC inverter in the first example embodiment.

FIG. 8 is a circuit diagram illustrating the inverter controller 164 of the DC-AC inverter 162.

The inverter controller 164 may be configured by a logic circuit 801 such as, but not limited to, a gate array.

A reference numeral 802 may denote a communication interface for performing communication with the printer engine controller 143.

Reference numerals 803, 804, 805, 806, 807, and 808 each may denote a PWM output terminal.

[Operation]

The image forming apparatus 100 illustrated in FIG. 1 may receive an input of printing data from an unillustrated external device through the host interface 140 illustrated in FIG. 2. The printing data may be described in page description language (PDL) or the like. The received printing data may be converted into bitmap data by the command image processor 141.

The image forming apparatus 100 may control the heaters 132, based on the detection value derived from the thermistor 131. This may set an unillustrated heat fixing roller of the fixing unit 130 to a predetermined temperature. After the heat fixing roller is set to the predetermined temperature, a printing operation may be initiated.

The hopping roller 105 may feed the medium PA set in the medium cassette 104. The resist roller 106 may cause the medium PA to be conveyed on the transfer belt 108 at timing synchronized with a later-described image forming operation. Each of the development units 110 may form the toner image on the photoreceptor drum 111, based on an electrophotographic process. At this time, each of the LED heads 102 may emit light in accordance with the bitmap data. Each of the toner images developed by the corresponding development unit 110 may be transferred, by means of the bias applied to the transfer roller 103, onto the medium PA conveyed on the transfer belt 108. The medium PA may be discharged after the toner images, which may be in four colors, are transferred thereon and after the fixing of the toner images is performed by the fixing unit 130.

The toner cartridge 101 which may be provided attachable to and detachable from the corresponding development unit 110 may feed the toner provided therein to the corresponding development unit 110.

The printer engine controller 143 illustrated in FIG. 2 may cause the high-voltage generator 150 to generate the high voltage. The high voltage generated by the high-voltage generator 150 may be applied to each of the charge roller 112, the development roller 114, and the transfer roller 103.

The printer engine controller 143 may control the low-voltage power supply 160 to control the electric power supplied to the fixing unit 130.

A description is given next with reference to FIG. 3.

The low-voltage power supply 160 may receive a supply of the electric power from the commercial power supply CP, and may perform switching of the alternating-current voltage, having been subjected to half-wave rectification by the power factor correction circuit 161, to step up the half-wave rectified alternating-current voltage. The stepped up voltage may be supplied to the downstream DC-AC inverter 162 and DC-DC converter 166 at an output of 390 V in DC. In the present example embodiment, the DC-DC converter 166 may perform switching of the direct-current voltage of DC 390 V, and output DC 24 V and DC 5 V following a step down operation performed by the transformer in which a primary side and a secondary side are isolated from each other.

The DC voltages of 5 V and 24 V outputted from the DC-DC converter 166 may respectively be supplied to logic systems of the printer engine controller 143, etc. and to drive systems of the hopping motor 151, etc. The 5 V DC voltage may be converted on an as-needed basis into any other voltage, such as 3.3 V, required in each substrate. The DC 24 V and the DC 5 V may be supplied to the DC-AC inverter 162. The DC 24 V may also be supplied to the PFC control IC 511 in the power factor correction circuit 161. At this time, no voltage may be supplied to the PFC control IC 511 of the power factor correction circuit 161 in an initial state; however, the power factor correction circuit 161 may operate as a capacitor-input rectifying circuit upon a turned-off state of the IGBTs 520 and 531 serving as switching devices of the power factor correction circuit 161 as can be appreciated from the circuit diagram illustrated in FIG. 5. Hence, upon an input of AC 100 V, DC 141 V may be supplied to the DC-DC converter 166, whereas DC 325 V may be supplied to the DC-DC converter 166 upon an input of AC 230 V. The DC-DC converter 166 may operate based on such inputs to output the DC 24 V, which voltage may cause the power factor correction circuit 161 to activate.

The DC-AC inverter 162 may have two outputs, outputs from which may be supplied to the respective heaters 132A and 132B. The DC-AC inverter 162 may perform switching of DC 390 V outputted from the power factor correction circuit 161 and smoothing of the thus-obtained output by means of an LC filter to output the alternating-current voltage having a variable output root mean square (RMS) value. The RMS value of the alternating current voltage and turning on and off of the inverter output may be controlled in accordance with signals supplied from the printer engine controller 143. The printer engine controller 143 may variably changes the inverter outputs to be applied to the heaters 132, based on the temperatures detected by the thermistor 131 and an operation state of the image forming apparatus 100.

FIG. 4 schematically illustrates the heaters 132.

The alternating-current voltage may be applied to the heater 132B having the heat generation length L2 that may correspond to the width of the medium having the size of A3, when the medium of A3, which may be, without limitation, the maximum size of the medium supported by the image forming apparatus 100, is conveyed. When the medium having the size of A4 is fed longitudinally, the alternating-current voltage may be applied to the heater 132A having the heat generation length L1 that may correspond to the width of the medium having the size of A4. The heater 132B that may correspond to the width of the medium having the size of A3 may be turned on auxiliary upon heating of the heater 132A that may correspond to the width of the medium having the size of A4 to apply an amount of heat to the fixing unit 130 more than that of the case where the heater 132A is heated alone.

A total amount of electric power available to the heaters 132 and the DC-DC converter 166 may be, for example but not limited to, 1425 W. The printer engine controller 143 may so perform a control as to allow an amount of electric power used by the heaters 132 and the DC-DC converter 166 to fall within the available range up to 1425 W. For example, the printer engine controller 143 may subtract electric power used in any other part of the image forming apparatus 100 from the available total amount of the electric power to perform the heating of the heaters 132 with use of the remaining electric power. Note that the total amount of electric power may be managed based on calculation in the present example embodiment; however, a total amount of actual electric power may be controlled using, for example but not limited to, a current detecting circuit. Also, the input of the electric power of 1500 W and the output of 1425 W in the power factor correction circuit 161 in the present example embodiment are illustrative and non-limiting. The values of the input and the output of the power factor correction circuit 161 may be determined based on various conditions including efficiency.

FIG. 5 is a circuit diagram of the power factor correction circuit 161.

The PFC control IC 511 may perform the switching of the IGBTs 520 and 531 in response to various inputs to control the output of the power factor correction circuit 161. The AC voltage received from the commercial power supply CP may travel through the common-mode choke coil 502, following which the AC voltage is subjected to the half-wave rectification by the bride diode 510. The diodes 503 and 504 may similarly perform the half-wave rectification in combination with the half of the bridge diode 510. The voltage following the half-wave rectification by the diodes 503 and 504 may be divided in voltage by the resistors 507 and 508. The divided voltage may be subjected to rectification and smoothing by the capacitor 509, following which the divided voltage having been subjected to rectification and smoothing may be supplied to an initial voltage input terminal of the PFC control IC 511. A value of the divided voltage may be compared with a reference voltage in a circuit of the PFC control IC 511. The PFC control IC 511 may initiate the control when the value of the divided voltage exceeds the reference voltage. The initial voltage input terminal may accept a sufficiently-low voltage in order to allow the power factor correction circuit 161 to support the universal input. A voltage divided in voltage by the resistors 505 and 508 may be supplied to an AC input voltage terminal to serve as a signal for controlling the switching performed by the PFC control IC 511. The electric power to be supplied to the PFC control IC 511 and the gate drive circuit blocks 541 and 542 may be at 24 V, which may be supplied from the DC 24 V power supply input section 512. The DC 24 V power supply input section 512, a description of which is to be described later in greater detail, may be an isolated power supply in which the 0 V input side is separated from a frame ground (FG). The PFC control IC 511 may output gate drive signals from a GD1 terminal and a GD2 terminal. The gate drive circuit blocks 541 and 542 may be so controlled as to allow a power factor to be close to 1 (one). The PFC control IC 511 may be any IC available from any of various semiconductor manufacturers.

The gate drive signals may be amplified in drive current by the NPN transistors 516 and 527 and the PNP transistors 517 and 528 as pairs in the gate drive circuit blocks 541 and 542 to cause the IGBTs 520 and 531 to be switched. The PFC control IC 511 may so control a switching duty ratio as to allow voltages, increased by the inductors 523 and 534, are subjected to smoothing by the respective diodes 524 and 535 and the electrolytic capacitor 536 and an output of DC +390 V is thus obtained. The thus-outputted voltage may be divided in voltage by the resistors 537 and 539 and the resistors 538 and 540 for the control described above. The voltage divided in voltage by the resistors 539 and 540 may be supplied to the PFC control IC 511 as a feedback voltage. The voltage divided in voltage by the resistors 537 and 538 may be supplied to the PFC control IC 511 as a voltage for an overvoltage detection. The PFC control IC 511 may so perform the control, by changing the switching duty ratio, as to allow the output voltage to be a constant voltage of +390 V in accordance with a change in an inverter load to be described later. Also, voltages generated by currents flowing to the current detecting resistors 522 and 532 may be supplied to the PFC control IC 511. The PFC control IC 511 may perform a process of, for example but not limited to, stopping the switching operation to prevent breakdown of the IGBTs 520 and 531 by an overcurrent when a detected voltage exceeds a predetermined threshold.

FIG. 6 is a circuit diagram of the DC-DC converter having a 24 V input and a 24 V output and in which the primary side and the secondary side are isolated from each other by a transformer. The DC-DC converter illustrated in FIG. 6 may be a typical self-excited flyback converter. The shunt regulator 614 may have a reference terminal that receives a voltage divided in voltage by the resistors 616 and 617. When an output voltage exceeds 24 V, a current may flow from a cathode to an anode of the shunt regulator 614, causing a current to flow to a secondary light-emitting diode of the photo coupler 610. Further, a current flowing to the primary side of the photo coupler 610 decreases a base current in the NPN transistor 602, allowing for a constant voltage control.

FIG. 7 is a circuit diagram of the switching section 163 of the DC-AC inverter 162 in the present example embodiment.

The switching section 163 may receive the signals from the inverter controller 164, and perform the switching of each of the IGBTs 715, 719, 728, 732, 742, and 746 to cause the DC 390 V to be switched, obtaining the alternating-current output.

The IGBTs 715, 719, 728, 732, 742, and 746 each may be any other device, non-limiting examples of which may include a silicon field-effect transistor (Si-FET), a silicon-carbide field-effect transistor (SiC-FET), and a gallium-nitride field-effect transistor (GaN-FET).

In performing switching, a pair of high-side and low-side IGBTs 715 and 719, a pair of high-side and low-side IGBTs 728 and 732, and a pair of high-side and low-side IGBTs 742 and 746 may each receive signals that are substantially inverted from each other to prevent flowing of a flow-through current resulting from simultaneous turning-on of the high-side and the low-side IGBTs of any of such pairs. Also, a dead time of 1 (one) microsecond may be provided as a time period during which both the high-side and the low-side IGBTs as a pair are turned off, to prevent occurrence of a time period in which both the high-side and the low-side IGBTs are turned on together by a delay in a turning-off period when the signals supplied to each of the pairs are pure inverted signals. In the present example embodiment, the dead time is 1 μsec, although the dead time may be a time period set on an as-needed basis based on used devices and switching frequencies and hence the dead time is not limited to 1 μsec.

The pair of high-side and low-side IGBTs 728 and 732, the pair of high-side and low-side IGBTs 715 and 719, and the pair of high-side and low-side IGBTs 742 and 746 may form a bridge circuit.

The pair of high-side and low-side IGBTs 728 and 732 may obtain an inverter output in combination with each of the pairs of high-side and low-side IGBTs 715 and 719 and high-side and low-side IGBTs 742 and 746. In the present example embodiment, the pair of IGBTs 728 and 732 may supply the switching outputs of the +390 V and 0 V to a connection point of an emitter of the IGBT 728 and a collector of the IGBT 732 at 50 Hz. The frequency of 50 Hz may be an output frequency of the DC-AC inverter 162. In the present example embodiment, the output frequency is set to 50 Hz, although any frequency may be set. The remaining IGBTs 715, 719, 742, and 746 may perform the switching in response to the output of the DC-AC inverter 162. A combination of the pair of IGBTs 728 and 732 and the pair of IGBTs 715 and 719 may cause a current to flow to one of the heaters 132 serving as a load, whereas a combination of the pair of IGBTs 728 and 732 and the pair of IGBTs 742 and 746 may cause a current to flow to the other heater 132 serving as the load.

The pair of high-side and low-side IGBTs 715 and 719 and the pair of high-side and low-side IGBTs 742 and 746 each may be turned on at its exclusive timing. The voltages following the switching may be subjected to removal of a high-frequency component present in switching frequency components by respective LC filters configured by the inductor 748 and the capacitor 749 and by the inductor 751 and the capacitor 752. The voltages following the removal of the high-frequency component may be supplied to the heaters 132 as sine wave outputs at 50 Hz.

The photo couplers 707, 708, 709, 710, 711, and 712 each may be a gate driver IC insulated by a photo coupler. A non-limiting example of such a gate driver IC may be a TLP251 available from Toshiba Corporation located in Minato-ku, Tokyo, Japan. The photo couplers 707, 708, 709, 710, 711, and 712 may receive a supply of electric power from the DC 24 V power supply input sections 701, 704, 721, and 735. These four side-by-side DC 24 V power supply input sections 701, 704, 721, and 735 each may be the power supply illustrated in FIG. 6. The DC 24 V power supply input section 704 may be the DC 24 V power supply input section 512 as illustrated in FIG. 5, achieving sharing of a power supply. The remaining DC 24 V power supply input sections 701, 721, and 735 each may be an insulated power supply for a high-side drive circuit and thus each may require insulation. The insulated power supply of the gate drive circuit may be any of various insulated power supplies and is not limited to a system employed in the present example embodiment. On the primary side of each of the photo couplers 707, 708, 709, 710, 711, and 712, the N-channel FETs 703, 706, 723, 725, 737, and 739 may be subjected to switching by the PWM signals supplied from the inverter controller 164 to cause currents to flow to primary side light-emitting diodes of the respective photo couples 707, 708, 709, 710, 711, and 712, thereby driving the gate drive circuit located on the secondary side.

FIG. 8 is a block diagram of the inverter controller 164 that may output the PWM signals.

The inverter controller 164 may be achieved by an application-specific integrated circuit (ASIC).

Based on the signals sent from the printer engine controller 143, the PWM output terminal 803 may output a PWM_A signal, the PWM output terminal 804 may output a PWM_B signal, and the PWM output terminal 805 may output a PWM_C signal. Further, based on the signals sent from the printer engine controller 143, the PWM output terminal 806 may output a PWM_D signal, the PWM output terminal 807 may output a PWM_E signal, and the PWM output terminal 808 may output a PWM_F signal. The printer engine controller 143 may output, for example but not limited to, a signal indicating starting of application of the voltage to each heater 132, a signal indicating increasing of the voltage applied to each heater 132, or a signal indicating decreasing of the voltage applied to each heater 132. The waveform memory 165 may store pieces of information on waveforms indicating duty ratios, corresponding to the predetermined number of respective voltages ranging from the maximum output voltage to the minimum output voltage to be applied to each heater 132, of the PWM_A signal, the PWM_B signal, the PWM_E signal, and the PWM_F signal. The inverter controller 164 may determine a waveform of the PWM_A signal, the PWM_B signal, the PWM_E signal, or the PWM_F signal and output the PWM signal having the determined waveform from the corresponding PWM output terminal, based on the signals sent from the printer engine controller 143 and on the pieces of waveform information stored in the waveform memory 165. Note that the ASIC is provided on the inverter side in the present example embodiment; however, a configuration may alternatively be employed in which the PWM signals are directly outputted from a large-scale integrated circuit of the printer engine controller 143.

Figure 9A:
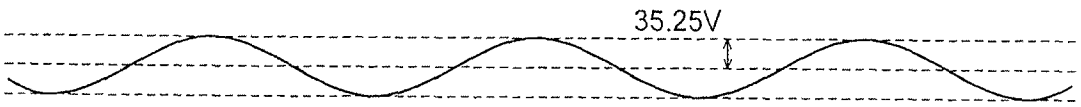
FIGS. 9A to 9C each schematically illustrate a waveform of a voltage outputted from the DC-AC inverter in the first example embodiment.
Figure 9B:
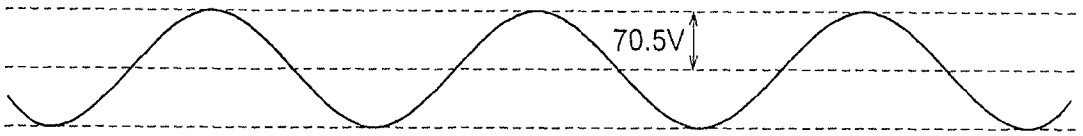
Figure 9C:
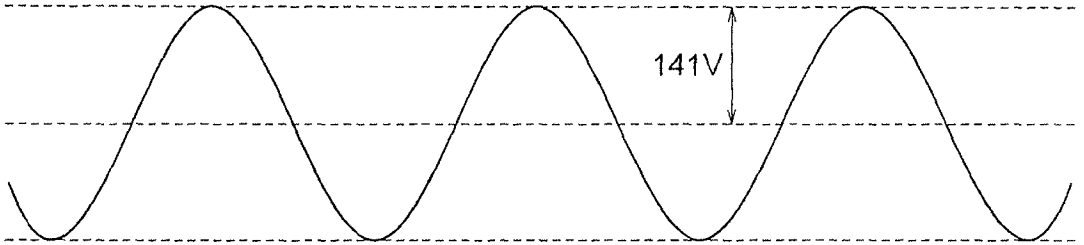

FIGS. 9A to 9C each schematically illustrate a waveform of a voltage outputted from the DC-AC inverter 162.

FIG. 9C illustrates the waveform where an AC output RMS value is AC 100 V with a peak of 141 V. FIG. 9B illustrates the waveform where the RMS value is half the RMS value illustrated in FIG. 9C, i.e., is AC 50 V. FIG. 9A illustrates the waveform where the RMS value is AC 25 V.

The printer engine controller 143 may control the DC-AC inverter 162 to cause a frequency of the AC output to be constant, and variably change a waveform of the AC output (amplitude in the present example embodiment, although it is not limited thereto) to control the heat generation of the heaters 132. The DC-AC inverter 162 may output alternating currents having different RMS values from each other to the respective heaters 132. Also, the printer engine controller 143 may so perform a control as to allow the AC voltage to be increased gradually from a low voltage, from a viewpoint of a large inrush current resulting from a low resistance value upon initiation of electric conduction of a halogen heater which is not warmed up. Such a control may be based on a similar idea to an existing phase angle control, i.e., a control of performing turning-on at 180 degrees entirely in the existing phase angle control may be equivalent to the output of AC 100 V from the DC-AC inverter 162 in the first example embodiment. Similarly, a control of performing turning-on at 90 degrees of a phase angle in the existing phase angle control may be equivalent to the output of AC 50 V from the DC-AC inverter 162 in the first example embodiment, and a control of performing turning-on at 45 degrees of the phase angle in the existing phase angle control may be equivalent to the output of AC 25 V from the DC-AC inverter 162 in the first example embodiment. Although the controls may not be equivalent to each other in an actual circuit operation, the operation is performable easily based on correction that may be determined from experiments, calculation, or the like on an as-needed basis. In the following, a description is given of a method of variably changing a sine wave voltage.

Figure 10:
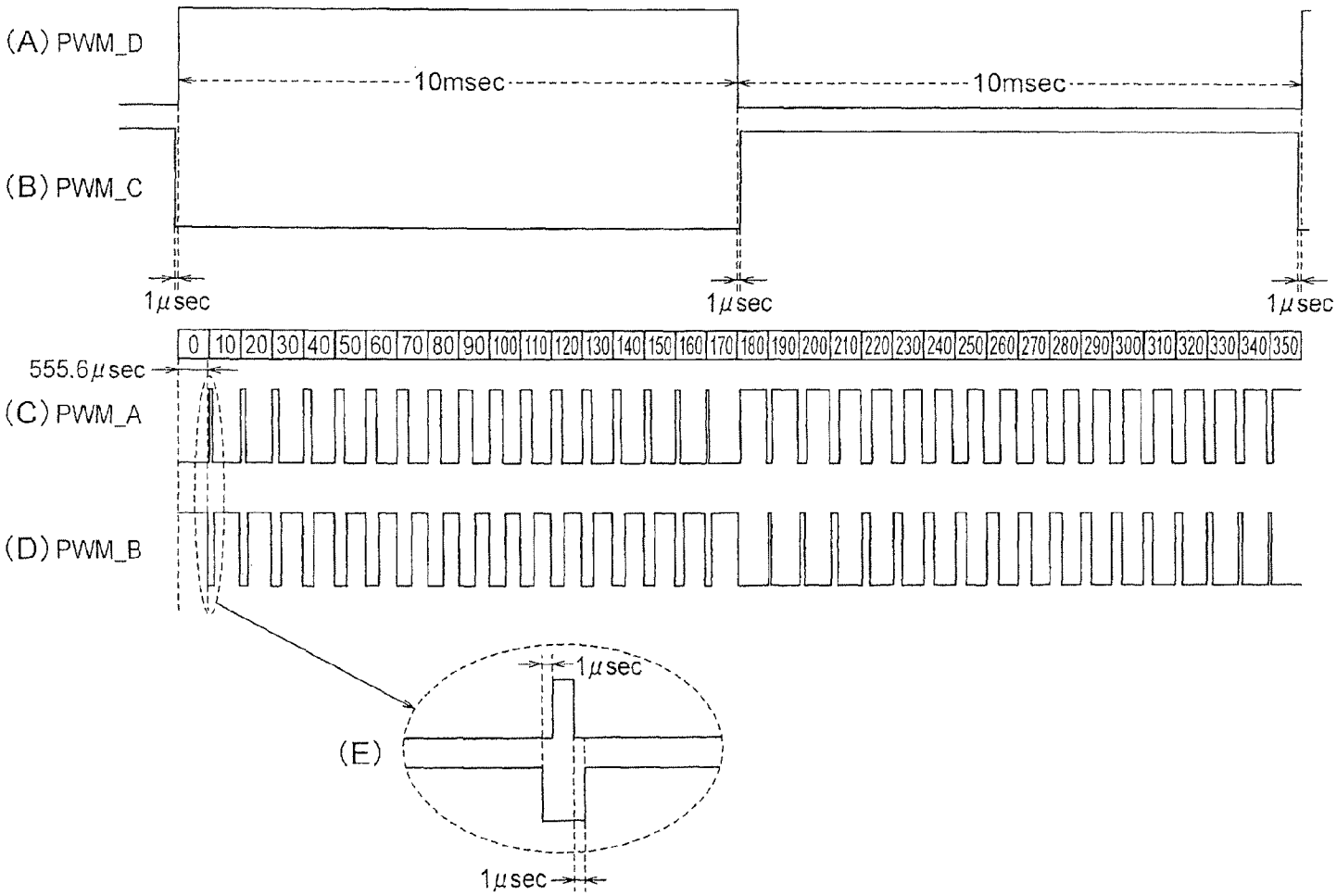
FIG. 10 is a schematic timing chart of PWM signals to be outputted from the inverter controller in the first example embodiment.

FIG. 10 is a schematic timing chart of PWM signals to be outputted from the inverter controller 164.

Parts (A) to (E) of FIG. 10 illustrate waveforms of the PWM signals for obtaining a sine wave inverter output.

Referring to Parts (A) and (B) of FIG. 10, the PWM_D signal and the PWM_C signal that may determine an output frequency each may have a 50 Hz rectangular wave.

Referring to Parts (C) and (D) of FIG. 10, the PWM_A signal and the PWM_B signal that may determine the amplitude of the output voltage each may have a frequency higher than 50 Hz. In FIG. 10, the PWM_A signal and the PWM_B signal are illustrated as having a frequency of 1.8 kHz (with a cycle of 555.6 microseconds) for purpose of simplicity in illustration. In practice, it is preferable that the PWM_A signal and the PWM_B signal each have a frequency of 20 kHz that exceeds an audible range or higher. However, a loss may increase with an increase in frequency; hence, an optimal value may be determined for the frequency of each of the PWM_A signal and the PWM_B signal, based on selected devices and outputs. A description is given of the present example embodiment where the PWM_A signal and the PWM_B signal each have a frequency of 1.8 kHz in FIG. 10; however, a supplemental description is also given of the present example embodiment where the PWM_A signal and the PWM_B signal each have a frequency of 20 kHz. In the present example embodiment, the IGBTs 715, 719, 728, 732, 742, and 746 are used for the switching section 163 and hence the frequency of 20 kHz may be set. A frequency well higher than 20 kHz is selectable in one embodiment where devices such as, but not limited to, GaN-FETs are used.

The rectangular waveforms to be outputted to the pair of high-side and low-side IGBTs 715 and 719 and the pair of high-side and low-side IGBTs 742 and 746 each may be provided with the dead time of 1 (one) microsecond as illustrated in Part (E) of FIG. 10. The dead time may be constant irrespective of the switching frequency. As illustrated in a table of FIG. 11, the duty ratios of the respective PWM signals may be determined by division of one cycle of a sine wave into 36 sections and use of a SIN function. In FIGS. 10 and 11, the PWM_A signal and the PWM_B signal are illustrated as having the frequency of 1.8 kHz. In the frequency of 20 kHz, a half cycle is 10 milliseconds and the number of cycles is 200 cycles. Hence, values determined by the following Expression (1) may be stored as a table to determine the duty ratios, where N is an integer ranging from 0 (zero) to 199.

$$\sin\left(N \times \left(\frac{180}{199}\right)^{*}\right) \qquad \text{[Expression (1)]}$$

A SIN value determined by the Expression (1) may be a duty ratio upon generation of a sine wave having a peak of 390 V. Thus, the SIN value may be multiplied by a coefficient to allow a necessary voltage to be obtained. For example, the SIN value may be multiplied by 0.362 (=141÷390) in a case of outputting AC 100 V. This is one of values listed in the column "Duty" in the table illustrated in FIG. 11. The values listed in the column "Duty" may be stored as a table, or may be determined by calculation on an as-needed basis.

The Expression (1) may be used in the case of 20 kHz. In the schematic diagram illustrated in FIG. 10, the following Expression (2) may be used to allow the SIN value to be 0.362 at a peak, where M is an integer ranging from 0 (zero) to 35.

$$\mathrm{ABS}\{\sin(M \times 10^{\circ})\} \qquad \text{[Expression (2)]}$$

Note that an influence of a distortion on the output may be negligible in the sine wave to be applied to each heater 132. Hence, the number of effective digits for the values in the table, the number of bits used for the calculation, etc., may be reduced on an as-needed basis depending on implementation, without raising any problem.

As illustrated in Part (C) of FIG. 10, the high-side one of the IGBTs 715 and 719 as the pair may be turned on while the low-side one of the IGBTs 728 and 732 as the pair switched at 50 Hz is turned on as illustrated in Part (A) of FIG. 10, causing the current to flow to the heater 132. Also, the low-side one of the IGBTs 715 and 719 as the pair may be turned on while the high-side one of the IGBTs 728 and 732 as the pair is turned on as illustrated in Part (B) of FIG. 10, causing the current to flow in an opposite direction to the heaters 132.

This may apply the alternating-current voltage to the heater 132. The voltage at 390 V may be subjected to smoothing by the LC filter to be the voltage having the maximum peak of 141 V. Although a description is given above of the present example embodiment where the voltage of 390 V is outputted from the power factor correction circuit 161 and AC 100 V is outputted from the DC-AC inverter 162, the voltages outputted from the power factor correction circuit 161 and the DC-AC inverter 162 may be different from those described above.

Figure 12:
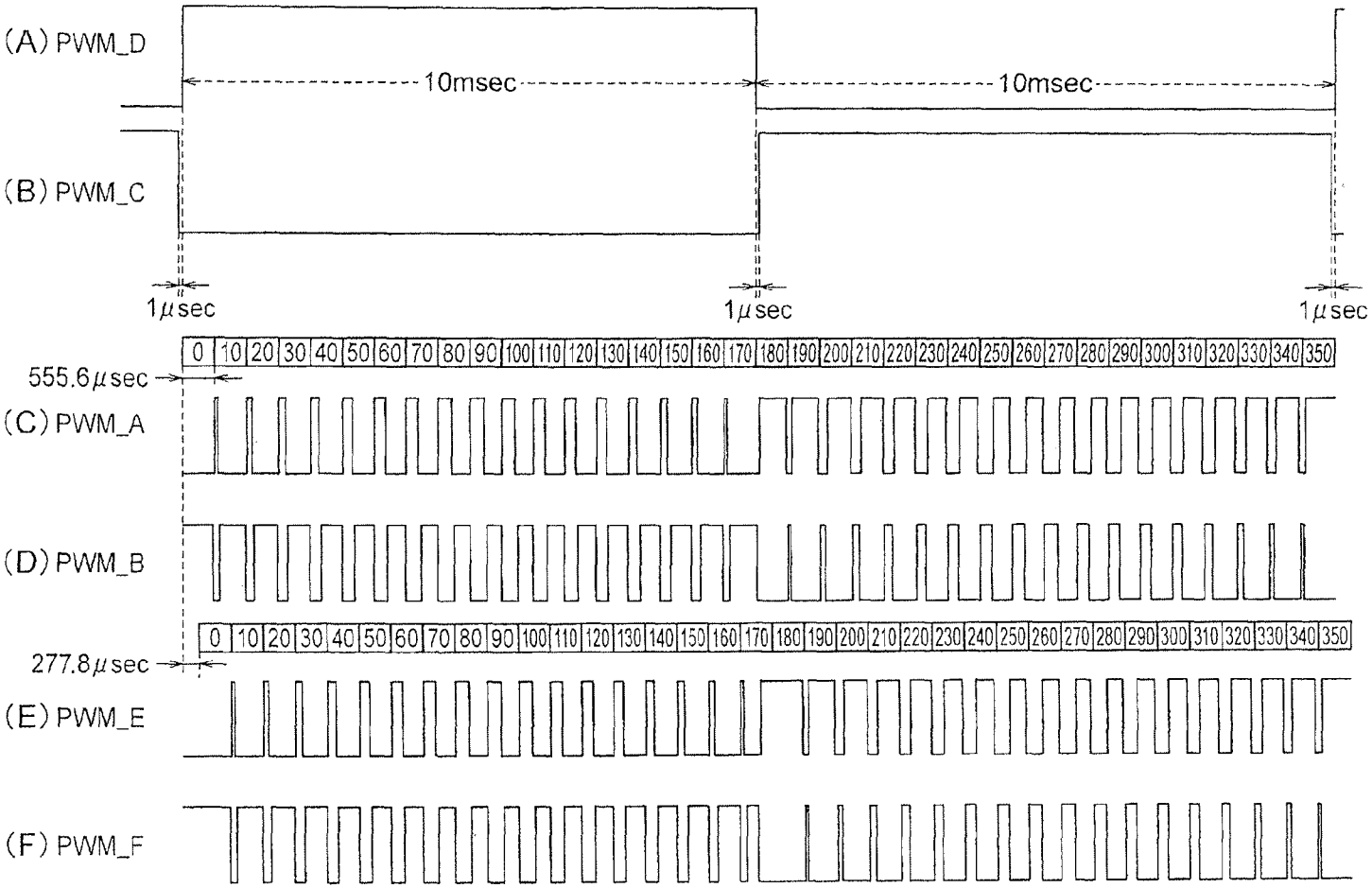
FIG. 12 schematically describes timing of rectangular waves to be outputted to respective pairs of IGBTs in the first example embodiment.

FIG. 12 schematically describes timing of rectangular waves to be outputted to the pair of IGBTs 715 and 719 and timing of rectangular waves to be outputted to the pair of IGBTs 742 and 746.

Although the duty ratios for the pairs are illustrated as being the same in FIG. 12 for description purpose, the pairs each may be supplied with a combination of outputs in which duty ratios are variably changed. The PWM output cycles may be staggered from each other by a half cycle, i.e., 277.8 microseconds in the schematic diagram of FIG. 12. In the case of 20 kHz, the PWM output cycles may be staggered from each other by 25 microseconds. The duty ratio upon the peak of the sine wave at the maximum output of AC 100 V may be 0.361 as described above. Hence, staggering the PWM output cycles by the half cycle allows the turning-on to be performed alternately. In other words, the timing at which the pair of IGBTs 715 and 719 are switched may be staggered from the timing at which the pair of IGBTs 742 and 746 are switched to prevent the timing at which the pair of IGBTs 715 and 719 are brought into electric conduction from being coincident with the timing at which the pair of IGBTs 742 and 746 are brought into electric conduction. This makes it possible to allow the peak current that flows to the pair of IGBTs 728 and 732 switched at 50 Hz to be equal even between one channel of inverter output and the two channels of inverter outputs. Also, it is possible to use the same IGBTs for all of the six IGBTs even when they are shared by the two channels of inverter outputs. Although the present example embodiment is described as having two outputs, a configuration may be employed in which three outputs are provided by causing the timing of rising of each PWM signals to be staggered by ⅓ cycle. An increase in the PFC output up to about 430 V may cause the peak duty ratio to be equal to or less than 33%, preventing overlapping of timing. In other words, the direct-current voltage to be outputted from the power factor correction circuit 161 may be previously so defined as to prevent a total of peak values of the duty ratios used to switch the pairs of IGBTs from exceeding 1 (one).

Figure 14:
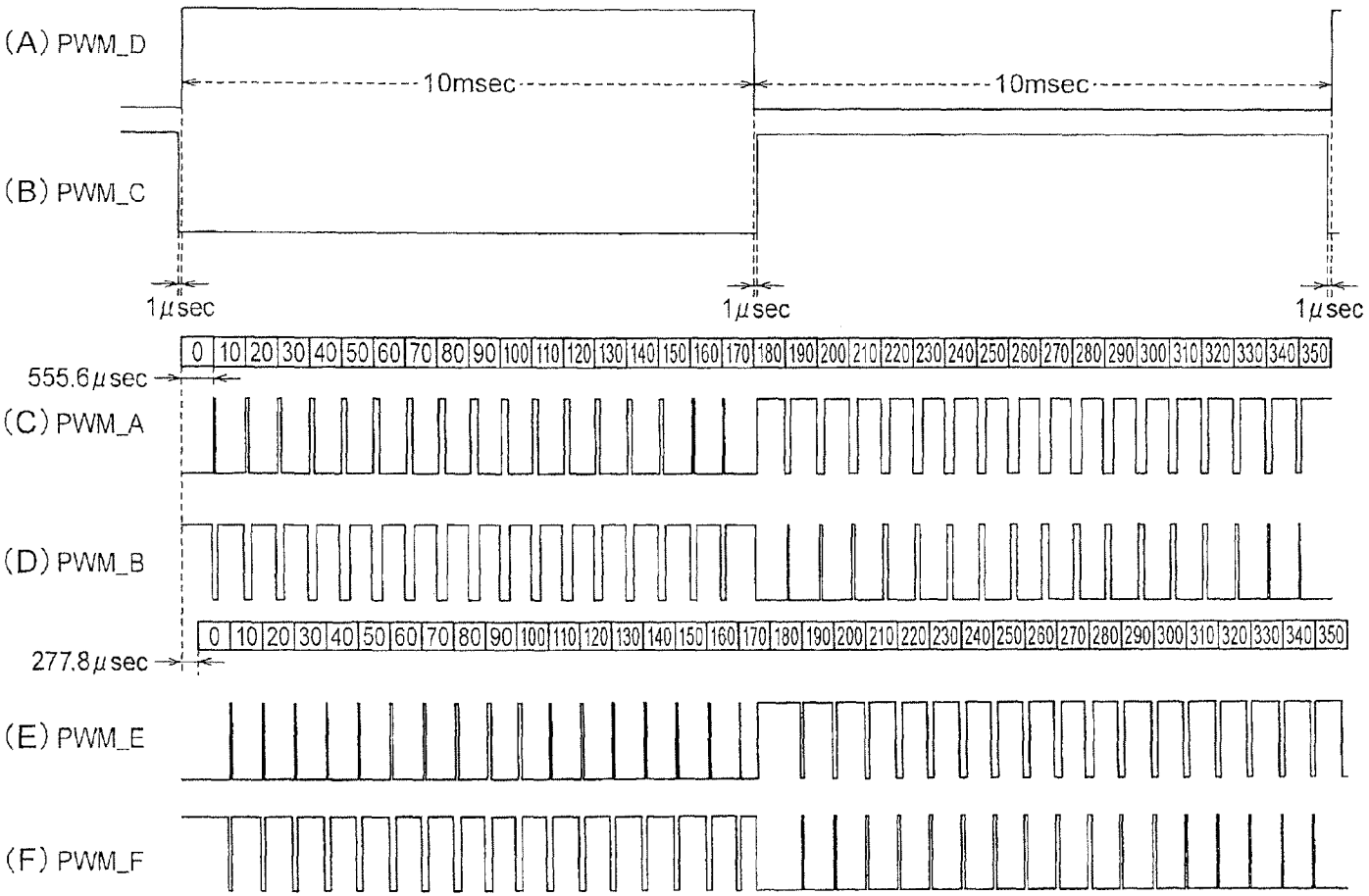
FIG. 14 illustrates duty ratios and timing in an example of 50 V in AC (a DC peak of 70.5 V) and an example of 25 V in AC (a DC peak of 35.25 V) in the first example embodiment.

A table of FIG. 13 and a schematic drawing of FIG. 14 respectively illustrate duty ratios and timing in an example of AC 50 V (a DC peak of 70.5 V) and an example of AC 25 V (a DC peak of 35.25 V).

The PWM_A signal and the PWM_B signal each may correspond to an output waveform of AC 50 V, and the PWM_E signal and the PWM_F signal each may correspond to an output waveform of AC 25 V.

In the present example embodiment as described above, the waveform memory 165 may store, for each heater 132, the duty ratios for determining the waveforms of the PWM signals used to output the maximum output from the DC-AC inverter 162, and may store the plurality of duty ratios for determining the waveforms of the PWM signals used to output the plurality of voltages that may be decreased from the maximum output on a predetermined voltage-to-voltage basis (for example, decreased from the maximum output with 1 V decrements).

The image forming apparatus 100 according to the present example embodiment may be provided with the heaters 132 having different heat generation lengths from each other. The heaters 132 may be selectively turned on depending on the sizes of the media. For example, the heater 132A for the medium having the width corresponding to the size of A4 may have an output of 700 W, and the heater 132B for the medium having the width corresponding to the size of A3 may have an output of 1000 W. Under such circumstances, in view of the output derived from the power factor correction circuit 161 which may be 1425 W as described above when the maximum electric power of the image forming apparatus 100 is 1500 W, and in view of power consumed by the DC-DC converter 166 as well, the heaters 132A and 132B may not be fully turned on together. However, the present example embodiment makes it possible to apply the outputs of 350 W and 500 W to the respective heaters 132A and 132B at AC 50 V from the DC-AC inverter 162 to warm up the heaters 132A and 132B upon power on, for example. Also, the present example embodiment makes it possible to perform a control in which one of the heaters 132 is fully turned on at AC 100 V and the other heater 132 is turned off depending on the size of the conveyed medium upon printing. It is also possible to perform a control in which the 700 W heater 132A having the width corresponding to the size of A4 is fully turned on and the 1000 W heater 132B is supplementarily turned on with an output of 250 W at AC 25 V, upon conveying of the longitudinally-fed medium having the size of A4. It is possible for the printer engine controller 143 to control a total of electric power of both the heaters 132A and 132B, based on a value derived from subtraction of the maximum consumption power of the DC-DC converter 166 from 1425 W as the maximum electric power available to the heaters 132. Further, a plurality of pieces of information on the consumption power of the DC-DC converter 166 according to operation states thereof may be stored in advance, and a control may be performed in which, in a warming up operation upon power on, motors other than those for the fixing unit 130 are stopped to perform warm up of the fixing unit 130 first and other initial operations are performed thereafter to allow for a prompt transition of states to a printable state.

Figure 15:
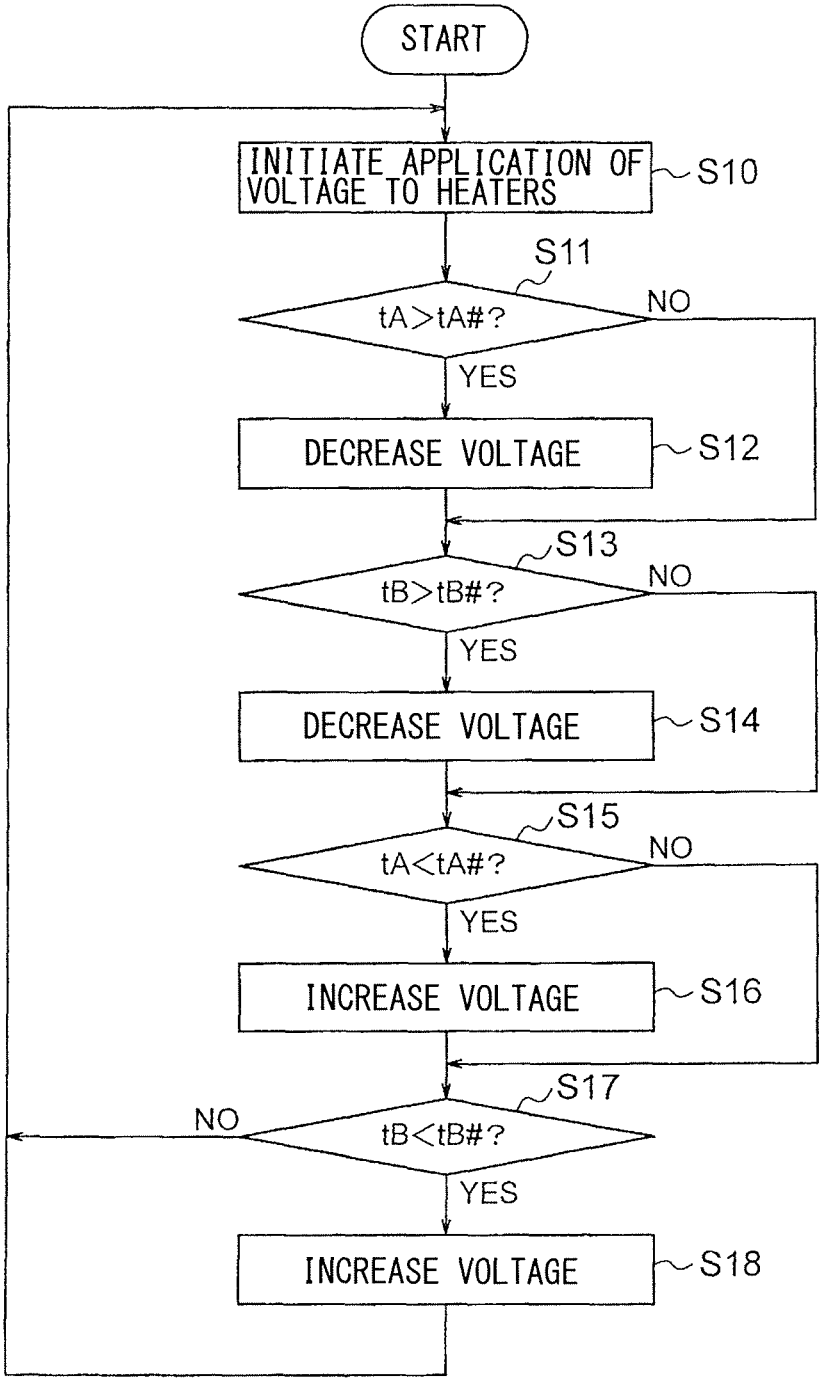
FIG. 15 is a flowchart illustrating a control of the DC-AC inverter performed by a printer engine controller in the first example embodiment.

FIG. 15 is a flowchart illustrating a control of the DC-AC inverter 162 performed by the printer engine controller 143 in the present example embodiment.

The flow illustrated in FIG. 15 may be started when the power of the image forming apparatus 100 is turned on.

When the power of the image forming apparatus 100 is turned on, the printer engine controller 143 may instruct the inverter controller 164 to initiate the application of the voltage to the heaters 132 (step S10). Upon receiving of the instructions from the printer engine controller 143, the inverter controller 164 may initiate the control in which the duty ratios, corresponding to the PWM signals having the waveforms that allow for the output of the maximum voltage, is read out and the maximum voltage is outputted while suppressing the inrush current, such that the maximum voltage is outputted to one of the heaters 132A and 132B. The voltage may be gradually increased over a time period of one second i.e., gradually increased over the sine waves of 50 cycles, when the output AC frequency is 50 Hz, until the AC sine wave voltage as the inverter output reaches the maximum voltage. The PWM output may be outputted, for each cycle of the output sine wave, on the basis of the duty ratio that is derived from multiplication of the value of the PWM duty ratio read out from the waveform memory 165 by sequential one of 1/50, 2/50, . . . , and 50/50. This results in output of the maximum voltage over a time period of one second. The PWM signals having such respective waveforms may be outputted from the PWM output terminals 803, 804, 807, and 808. The inverter controller 164 may cause the PWM signals, having the rectangular waves corresponding to the frequency of the alternating-current voltage to be outputted from the DC-AC inverter 162, to be outputted from the PWM output terminals 805 and 806.

Then, the printer engine controller 143 may make a determination as to whether a temperature tA of the heater 132A is greater than a temperature tA#, based on the detection value derived from the thermistor 131 that measures the temperature of the heater 132A (step S11). The temperature tA# may be a predetermined target temperature. When the temperature tA is determined as being greater than the temperature tA# as a threshold (Yes in S11), the process proceeds to step S12. When the temperature tA is determined as being equal to or less than the temperature tA# as the threshold (No in S11), the process proceeds to step S13.

In the step S12, the printer engine controller 143 may instruct the inverter controller 164 to decrease the voltage applied to the heater 132A. Upon receiving of the instructions from the printer engine controller 143, the inverter controller 164 may read out, from the waveform memory 165, the duty ratio corresponding to the PWM signals having the waveforms that cause the voltage, lower than the voltage currently applied to the switching section 163 by one step, to be outputted. Further, the inverter controller 164 may output the PWM signals having those waveforms from the PWM output terminals 803 and 804, such that the voltage becomes one step lower than the voltage currently applied to the switching section 163.

In the step S13, the printer engine controller 143 may make a determination as to whether a temperature tB of the heater 132B is greater than a temperature tB#, based on the detection value derived from the thermistor 131 that measures the temperature of the heater 132B. The temperature tB# may be a predetermined target temperature. When the temperature tB is determined as being greater than the temperature tB# as a threshold (Yes in S13), the process proceeds to step S14. When the temperature tB is determined as being equal to or less than the temperature tB# as the threshold (No in S13), the process proceeds to step S15.

In the step S14, the printer engine controller 143 may instruct the inverter controller 164 to decrease the voltage applied to the heater 132B. Upon receiving of the instructions from the printer engine controller 143, the inverter controller 164 may read out, from the waveform memory 165, the duty ratio corresponding to the PWM signals having the waveforms that cause the voltage, lower than the voltage currently applied to the switching section 163 by one step, to be outputted. Further, the inverter controller 164 may output the PWM signals having those waveforms from the PWM output terminals 807 and 808, such that the voltage becomes one step lower than the voltage currently applied to the switching section 163.

In the step S15, the printer engine controller 143 may make a determination as to whether the temperature tA of the heater 132A is less than the predetermined target temperature tA#, based on the detection value derived from the thermistor 131 that measures the temperature of the heater 132A. When the temperature tA is determined as being less than the temperature tA# as the threshold (Yes in S15), the process proceeds to step S16. When the temperature tA is determined as being equal to or greater than the temperature tA# as the threshold (No in S15), the process proceeds to step S17.

In the step S16, the printer engine controller 143 may instruct the inverter controller 164 to increase the voltage applied to the heater 132A. Upon receiving of the instructions from the printer engine controller 143, the inverter controller 164 may read out, from the waveform memory 165, the duty ratio corresponding to the PWM signals having the waveforms that cause the voltage, higher than the voltage currently applied to the switching section 163 by one step, to be outputted. Further, the inverter controller 164 may output the PWM signals having those waveforms from the PWM output terminals 803 and 804, such that the voltage becomes one step higher than the voltage currently applied to the switching section 163.

In the step S17, the printer engine controller 143 may make a determination as to whether the temperature tB of the heater 132B is less than the predetermined target temperature tB#, based on the detection value derived from the thermistor 131 that measures the temperature of the heater 132B. When the temperature tB is determined as being less than the temperature tB# as the threshold (Yes in S17), the process proceeds to step S18. When the temperature tB is determined as being equal to or greater than the temperature tB# as the threshold (No in S17), the process returns to step S11.

In the step S18, the printer engine controller 143 may instruct the inverter controller 164 to increase the voltage applied to the heater 132B. Upon receiving of the instructions from the printer engine controller 143, the inverter controller 164 may read out, from the waveform memory 165, the duty ratio corresponding to the PWM signals having the waveforms that cause the voltage, higher than the voltage currently applied to the switching section 163 by one step, to be outputted. Further, the inverter controller 164 may output the PWM signals having those waveforms from the PWM output terminals 807 and 808, such that the voltage becomes one step higher than the voltage currently applied to the switching section 163.

The inverter controller 164 may maintain the current waveforms upon receiving of instructions from the printer engine controller 143 to increase the voltage when the voltage corresponding to the waveforms currently outputted is the highest in value. Likewise, the inverter controller 164 may maintain the current waveforms upon receiving of instructions from the printer engine controller 143 to decrease the voltage when the voltage corresponding to the waveforms currently outputted is the lowest in value.

As described in the foregoing, the circuit having a combination of the power factor correction circuit 161 and the DC-AC inverter 162 is used for controlling the electric power to be applied to the heaters 132 in the fixing unit 130 of the image forming apparatus 100, making it possible to achieve a high power factor. Also, the inrush current applied to the heaters 132 is suppressed, making it possible to reduce a harmonic current. In addition, it is possible to prevent fluctuation in voltage applied to the heaters 132 irrespective of fluctuation in voltage of the commercial power supply CP. Further, the necessity of preparing different types of heaters 132 according to the voltages of the commercial power supply CP is eliminated, making it possible for the image forming apparatus 100 to support the universal input.

[Second Embodiment]

[Configuration]

Referring to FIG. 1, an image forming apparatus 200 according to a second example embodiment may have a configuration similar to the configuration of the image forming apparatus 100 according to the first example embodiment.

The image forming apparatus 200 according to the second example embodiment differs in configuration of a low-voltage power supply 260 from the image forming apparatus 100 according to the first example embodiment as illustrated in FIG. 2.

Referring to FIG. 3, the low-voltage power supply 260 in the second example embodiment may include the power factor correction circuit 161, a DC-AC inverter 262, and the DC-DC converter 166. The low-voltage power supply 260 in the second example embodiment differs in configuration of the DC-AC inverter 262 from the low-voltage power supply 160 in the first example embodiment.

The DC-AC inverter 262 in the second example embodiment may include the switching section 163, an inverter controller 264, and a waveform memory 265. The DC-AC inverter 262 in the second example embodiment differs in configurations of the inverter controller 264 and the waveform memory 265 from the DC-AC inverter 162 in the first example embodiment.

The inverter controller 264 may output the PWM signals to the switching section 163 in accordance with the signals supplied from the printer engine controller 143 to control the voltage to be outputted from the DC-AC inverter 262. The inverter controller 264 in the second example embodiment differs in output waveforms of the PWM signals from the inverter controller 164 in the first example embodiment.

The inverter controller 264 in the second example embodiment may also be configured by the logic circuit 801 as illustrated by way of example in FIG. 8.

The waveform memory 265 may store the pieces of waveform information that determine the waveforms of the PWM signals to be outputted from the inverter controller 264.

[Operation]

A description is given below of an operation performed in the second example embodiment. Note that an operation similar to that of the first example embodiment will not be described in detail.

Figure 16A:
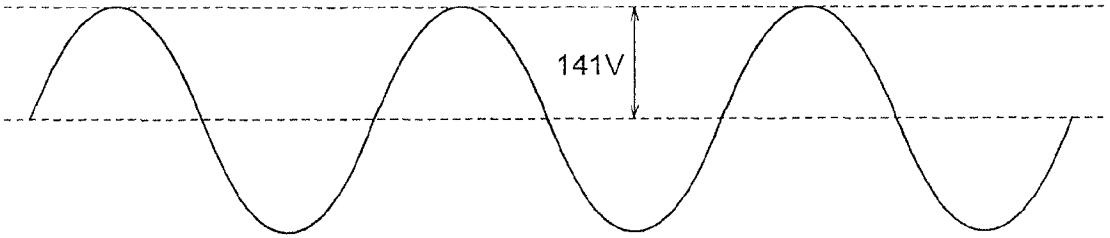
FIGS. 16A to 16C each schematically illustrate an output waveform derived from a DC-AC inverter in the second example embodiment.
Figure 16B:
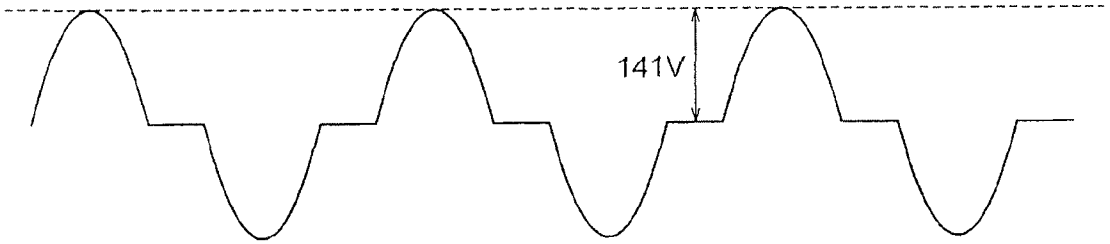
Figure 16C:
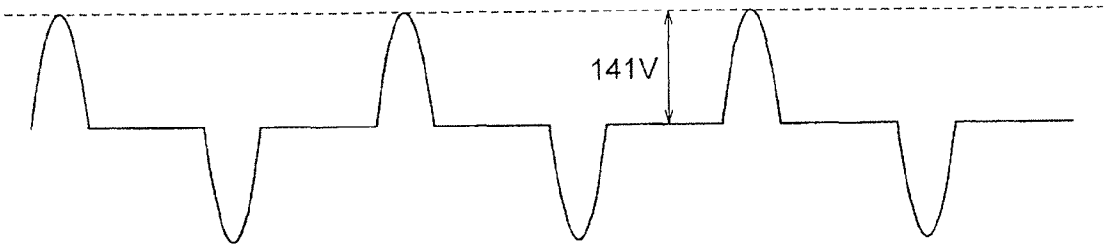

FIGS. 16A to 16C each schematically illustrate an output waveform derived from the DC-AC inverter 262 in the second example embodiment.

In the first example embodiment, the amplitude of the AC output voltage is variably changed to control the RMS value of the AC output voltage. In the second example embodiment, a peak of the amplitude is made constant, and an output width of a sine wave is varied to variably change the RMS value. In other words, an output frequency derived from the DC-AC inverter 262 is maintained at 50 Hz, and a waveform of a sine wave is set at a frequency higher than 50 Hz in a half cycle of the sine wave to lower the RMS value. Such a control may be achieved by changing the PWM signals to be outputted from the inverter controller 264, based on the duty ratios indicated by the pieces of waveform information stored in the waveform memory 265.

Figure 18:
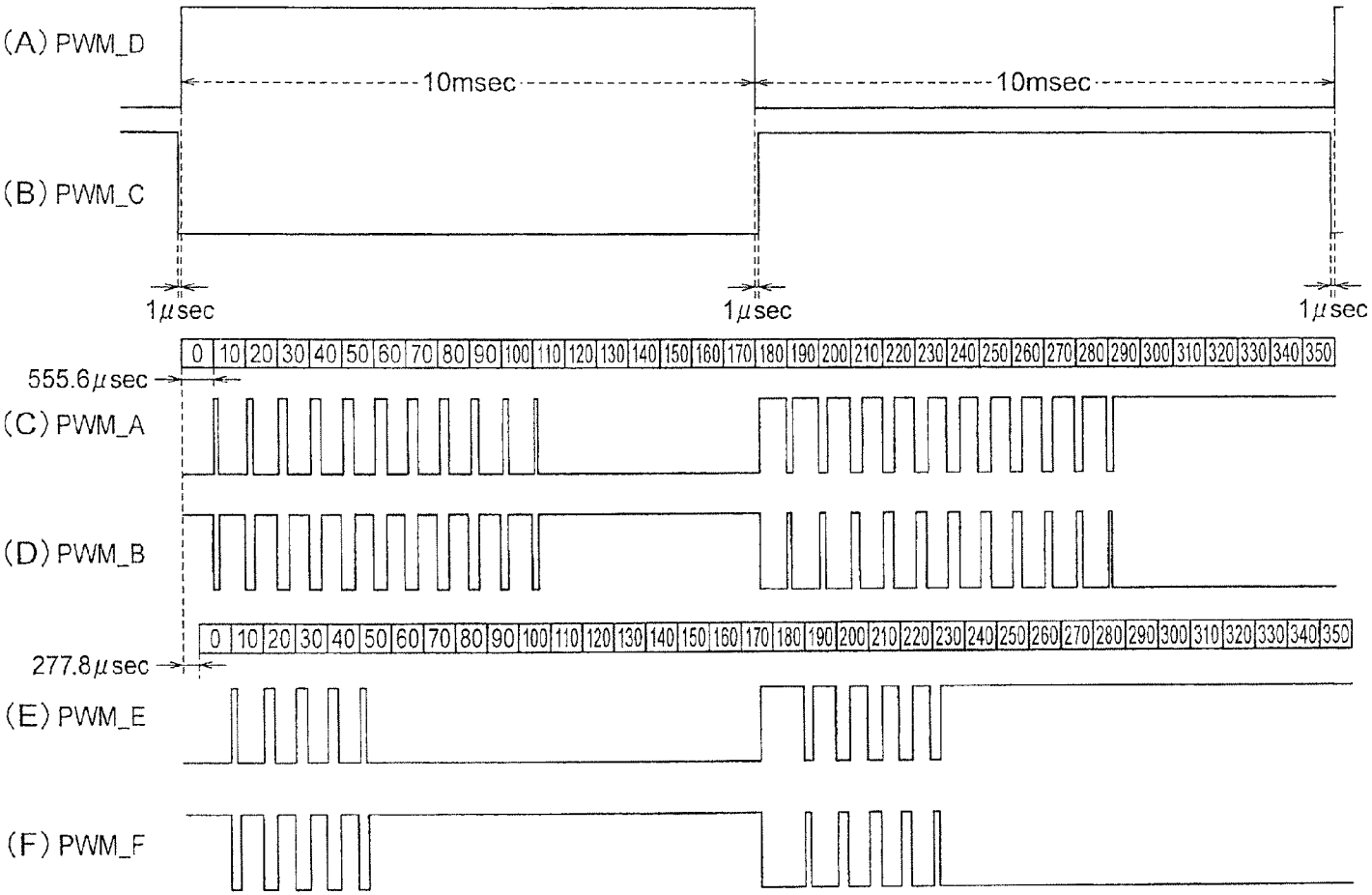
FIG. 18 is a schematic timing chart of the PWM signals to be outputted from the inverter controller in the second example embodiment.

FIG. 17 is a table illustrating an example of the duty ratios of the respective PWM signals to be outputted from the inverter controller 264. FIG. 18 is a schematic timing chart of the PWM signals to be outputted from the inverter controller 264. In FIGS. 17 and 18, the frequency of each of the PWM signals is set to 1.8 kHz as in the first example embodiment, although the frequency may be set to any other frequency such as, but not limited to, 20 kHz.

A pair of PWM_A and PWM_B signals illustrated in Part (C) and Part (D) of FIG. 18 may be the PWM signals upon the output RMS value of AC 67 V. A pair of PWM_E and PWM_F signals illustrated in Part (E) and Part (F) of FIG. 18 may be the PWM signals upon the output RMS value of AC 33 V. The second example embodiment also makes it possible to variably change the AC RMS value in a range from AC 0 V to AC 100 V using a table or calculation. Also, as in the first example embodiment, the timing of rising of each of the PWM_A and PWM_B signals as a pair and the timing of rising of each of the PWM_E and PWM_F signals as a pair may also be staggered with respect to each other by a half cycle in the second example embodiment.

The inrush current may also be large in the second example embodiment upon the initial stage of the electric conduction performed on the heaters 132. Hence, the control of variably changing the amplitude may be performed as in the first example embodiment only at the time of start-up. It is possible to vary the amplitude easily by multiplying each of the duty ratios described above by a predetermined value. Also, the control in the first example embodiment and the control in the second example embodiment may be combined with each other. For example, the amplitude control described in the first example embodiment may be performed until a predetermined time period elapses from the initiation of the electric conduction performed on the heaters 132, following which the waveform control in the second example embodiment may be performed.

Although the control is so performed in the second example embodiment as to variably change the width of the sinusoidal voltage, it is also possible to variably change the applied RMS value by making the width of the sinusoidal voltage constant and variably changing a cycle of rectangular waves to be applied to the pair of IGBTs 728 and 732. Such a control makes it possible to achieve effects similar to those achieved by an existing frequency control, as well as to eliminate an influence of, such as, but not limited to, a flicker by virtue of the power factor correction circuit 161.

As described in the foregoing, the second example embodiment controls the width of the sinusoidal voltage to be outputted from the DC-AC inverter 262, i.e., controls time it takes for the voltage outputted from the DC-AC inverter 262 to be outputted as the sine wave. This makes the peak of the voltage applied to each heater 132 constant, making it possible to apply the voltage to each heater 132 in a manner similar to an existing frequency control.

[Third Embodiment]

[Configuration]

Referring to FIG. 1, an image forming apparatus 300 according to a third example embodiment may have a configuration similar to the configuration of the image forming apparatus 100 according to the first example embodiment, but differs from the image forming apparatus 100 according to the first example embodiment in a configuration of a fixing unit 330.

The image forming apparatus 300 according to the third example embodiment differs in configurations of a low-voltage power supply 360, the fixing unit 330, and a printer engine controller 343 from the image forming apparatus 100 according to the first example embodiment as illustrated in FIG. 2.

Figure 19:
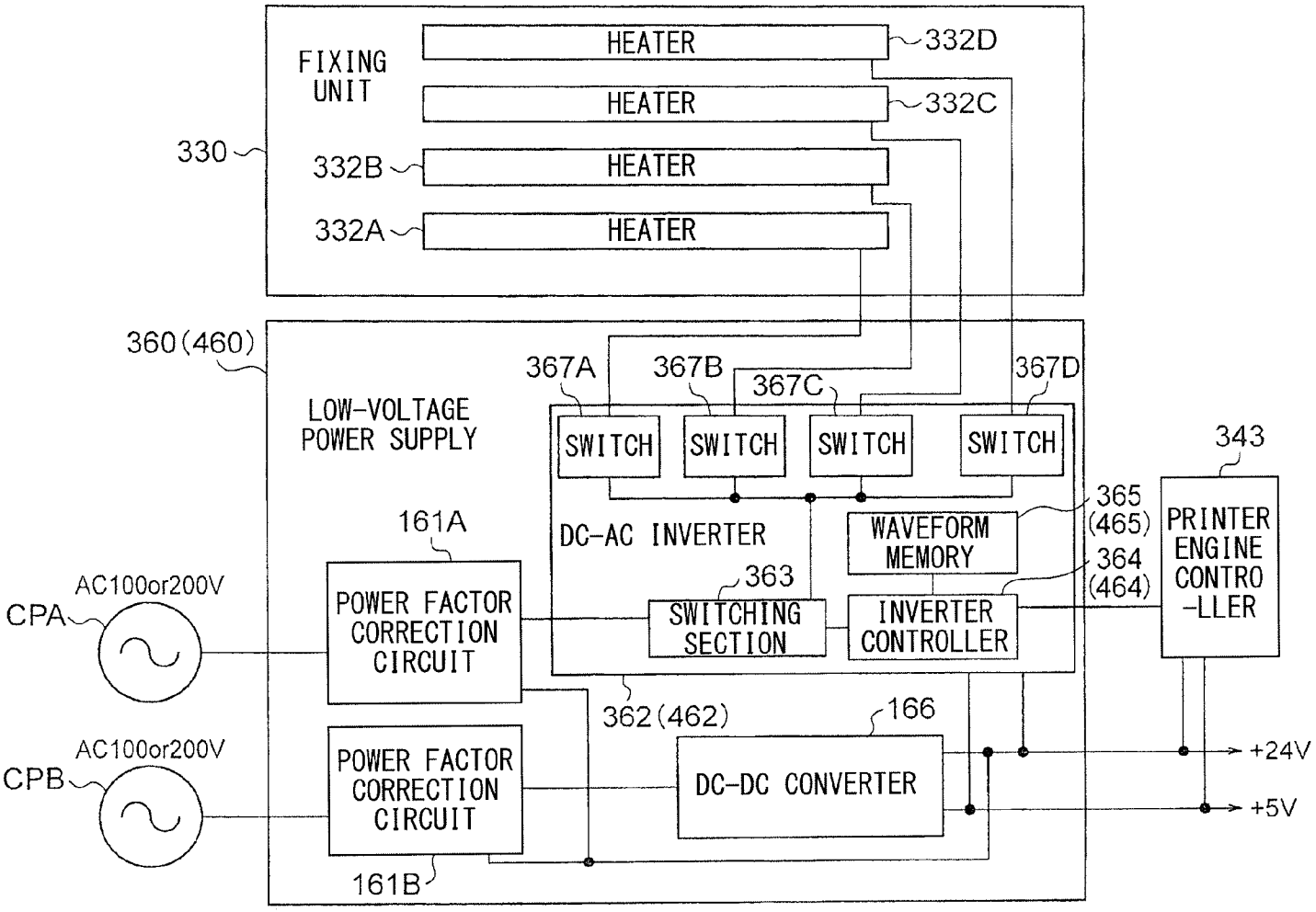
FIG. 19 is a block diagram schematically illustrating a configuration of a low-voltage power supply in the third example embodiment or the fourth example embodiment.

FIG. 19 is a block diagram schematically illustrating a configuration of the low-voltage power supply 360 in the third example embodiment.

The fixing unit 330 may include four heaters 332A, 332B, 332C, and 332D. The heaters 332A, 332B, 332C, and 332D may hereinafter be referred to as heaters 332 unless otherwise stated to distinguish them from one another. The heaters 332 in the present example embodiment each may also be a halogen heater, although any other heater may be used.

The low-voltage power supply 360 may receive one of two inputs of AC 100 V or AC 200 V from respective external commercial power supplies CPA and CPB. In a case of receiving AC 100 V, the present example embodiment may receives two inputs, in view of an upper limit of an output of a regular receptacle or a wall outlet which is typically 1500 W. In a case of using AC 200 V, the present example embodiment may receive two inputs from a single commercial power supply. Note that the voltages of the respective inputs are not limited to AC 100 V or AC 200V.

The low-voltage power supply 360 may include power factor correction circuits 161A and 161B, a DC-AC inverter 362, and the DC-DC converter 166. The power factor correction circuits 161A and 161B may hereinafter be referred to as the power factor correction circuits 161 unless otherwise stated to distinguish them from one another.

The power factor correction circuits 161 each convert the commercial alternating-current voltage into the direct-current voltage, and each output the converted direct-current voltage. Although two power factor correction circuits 161 are provided in the present example embodiment, the power factor correction circuits 161 each may have a configuration similar to that in the first example embodiment.

The DC-AC inverter 362 is an inverter that converts the direct-current voltage into the alternating-current voltage. The DC-AC inverter 362 may include a switching section 363, an inverter controller 364, a waveform memory 365, and switches 367A, 367B, 367C, and 367D. The switches 367A, 367B, 367C, and 367D may hereinafter be referred to as switches 367 unless otherwise stated to distinguish them from one another. The DC-AC inverter 362 in the present example embodiment may output alternating-current voltages that are same in frequency as one another but different in waveform from one another to allow voltages having higher RMS values to be outputted gradually upon wake-up of the heaters 332. The DC-AC inverter 362 may turn the switches 367 on and off to control the alternating-current voltages to be applied to the heaters 332 upon managing the temperature of each of the heaters 332.

The DC-DC converter 166 may step down the direct-current voltage to generate the different direct-current voltage.

The low-voltage power supply 360, the printer engine controller 343, and the heaters 332 may structure a heater control unit in one embodiment of the invention.

Figure 20:
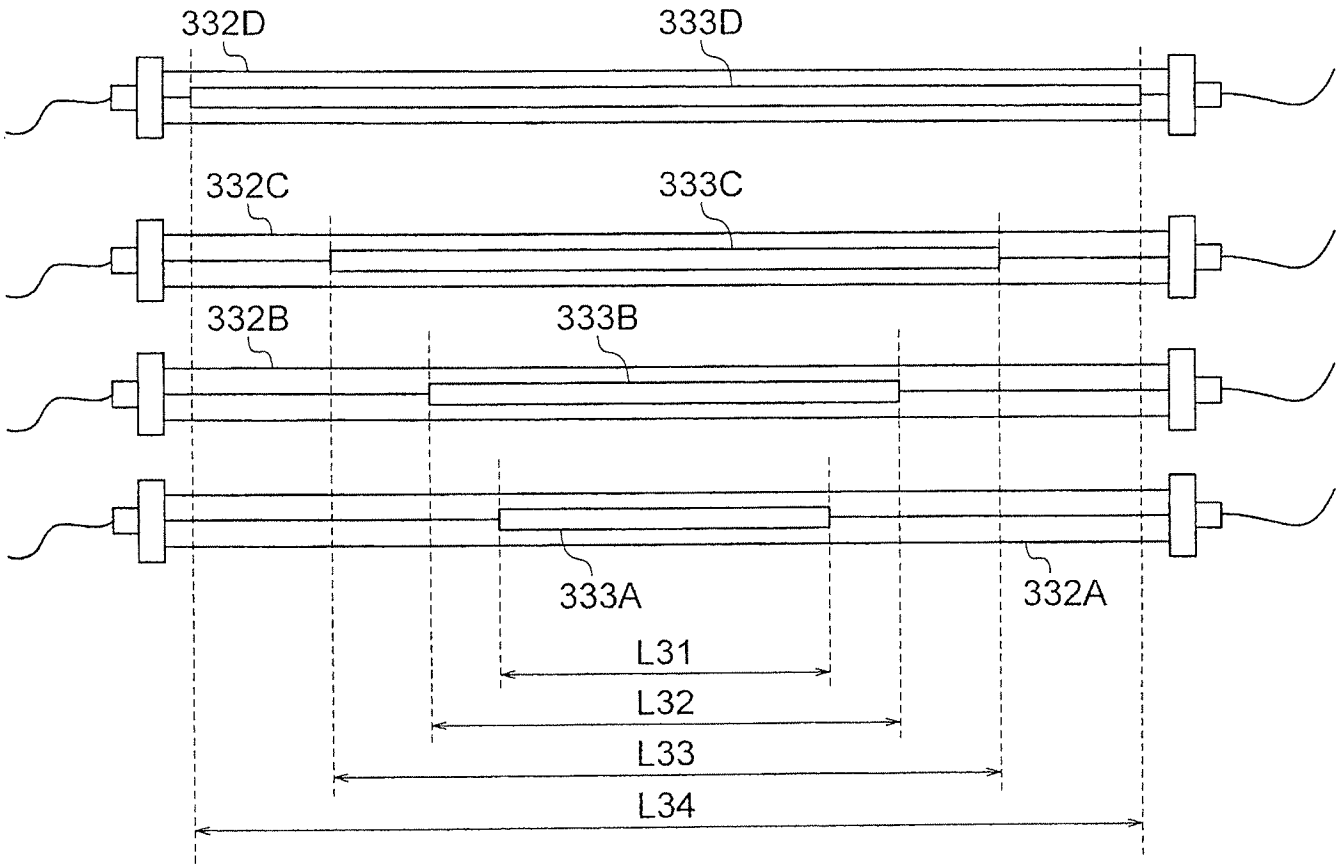
FIG. 20 schematically describes heaters provided in a fixing unit in the third example embodiment.

FIG. 20 schematically describes the heaters 332 provided in the fixing unit 330.

The heater 332A may be mounted with a filament 333A. The filament 333A may have a heat generation length L31 corresponding to a width of a longitudinally-fed medium that may have a size of A4. In the present example embodiment, the heater 332A may have an output of 500 W, although the heater 332A is not limited thereto.

The heater 332B may be mounted with a filament 333B. The filament 333B may have a heat generation length L32 corresponding to a width of a longitudinally-fed medium that may have a size of A3. In the present example embodiment, the heater 332B may have an output of 700 W, although the heater 332B is not limited thereto.

The heater 332C may be mounted with a filament 333C. The filament 333C may have a heat generation length L33 corresponding to a width of a longitudinally-fed medium that may have a size of A2. In the present example embodiment, the heater 332C may have an output of 1000 W, although the heater 332C is not limited thereto.

The heater 332D may be mounted with a filament 333D. The filament 333D may have a heat generation length L34 corresponding to a width of a longitudinally-fed medium that may have a size of A1. In the present example embodiment, the heater 332D may have an output of 1400 W, although the heater 332D is not limited thereto.

Figure 21:
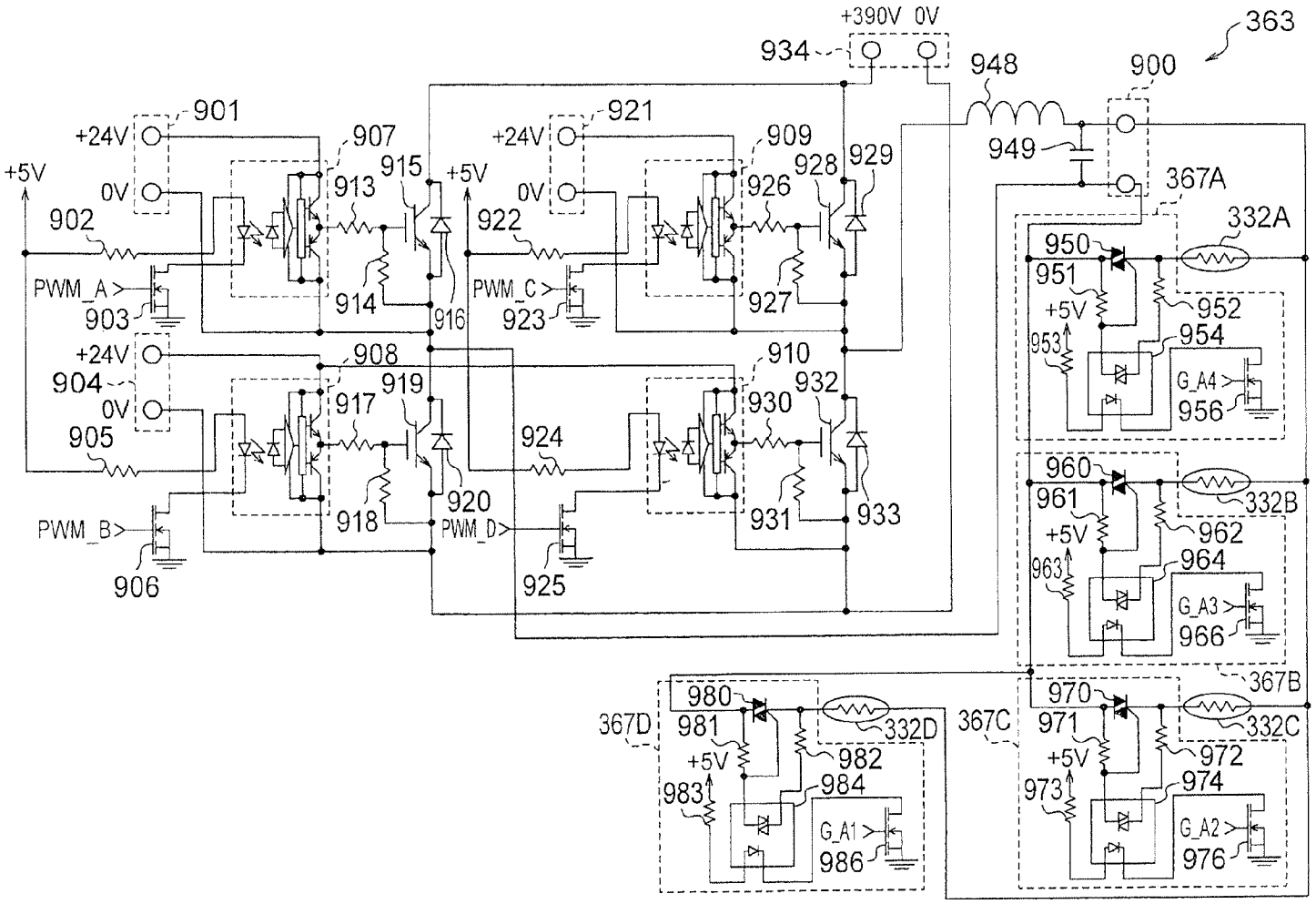
FIG. 21 is a circuit diagram illustrating a switching section and switches of a DC-AC inverter in the third example embodiment.

FIG. 21 is a circuit diagram illustrating the switching section 363 and the switches 367 of the DC-AC inverter 362.

The DC-AC inverter 362 may be controlled in switching timing by the PWM signals outputted from the inverter controller 364 to be described later in detail.

A reference numeral 901 may denote a DC 24 V power supply input section. A reference numeral 902 may denote a resistor. A reference numeral 903 may denote an N-channel FET. A reference numeral 904 may denote a DC 24 V power supply input section. A reference numeral 905 may denote a resistor. A reference numeral 906 may denote an N-channel FET. Reference numerals 907, 908, 909, and 910 each may denote a photo coupler such as, but not limited to, TLP 251. Reference numerals 913 and 914 each may denote a resistor. A reference numeral 915 may denote an IGBT. A reference numeral 916 may denote a diode. Reference numerals 917 and 918 each may denote a resistor. A reference numeral 919 may denote an IGBT. A reference numeral 920 may denote a diode. A reference numeral 921 may denote a DC 24 V power supply input section. A reference numeral 922 may denote a resistor. A reference numeral 923 may denote an N-channel FET. A reference numeral 924 may denote a resistor. A reference numeral 925 may denote an N-channel FET. Reference numerals 926 and 927 each may denote a resistor. A reference numeral 928 may denote an IGBT. A reference numeral 929 may denote a diode. Reference numerals 930 and 931 each may denote a resistor. A reference numeral 932 may denote an IGBT. A reference numeral 933 may denote a diode. A reference numeral 934 may denote a DC 390 V power supply input section. A reference numeral 948 may denote an inductor. A reference numeral 949 may denote a capacitor. A reference numeral 900 may denote an inverter output section.

The heaters 332 are coupled in parallel to the inverter output section 900 through the respective switches 367. The switches 367 each may be an alternating-current switch that turns on and off the alternating-current voltage to be applied to the corresponding heater 332.

A reference numeral 950 may denote a triac. Reference numerals 951, 952, and 953 each may denote a resistor. A reference numeral 954 may denote a photo triac. A reference numeral 956 may denote an N-channel FET. A reference numeral 960 may denote a triac. Reference numerals 961, 962, and 963 each may denote a resistor. A reference numeral 964 may denote a photo triac. A reference numeral 966 may denote an N-channel FET. A reference numeral 970 may denote a triac. Reference numerals 971, 972, and 973 each may denote a resistor. A reference numeral 974 may denote a photo triac. A reference numeral 976 may denote an N-channel FET. A reference numeral 980 may denote a triac. Reference numerals 981, 982, and 983 each may denote a resistor. A reference numeral 984 may denote a photo triac. A reference numeral 986 may denote an N-channel FET.

Figure 22:
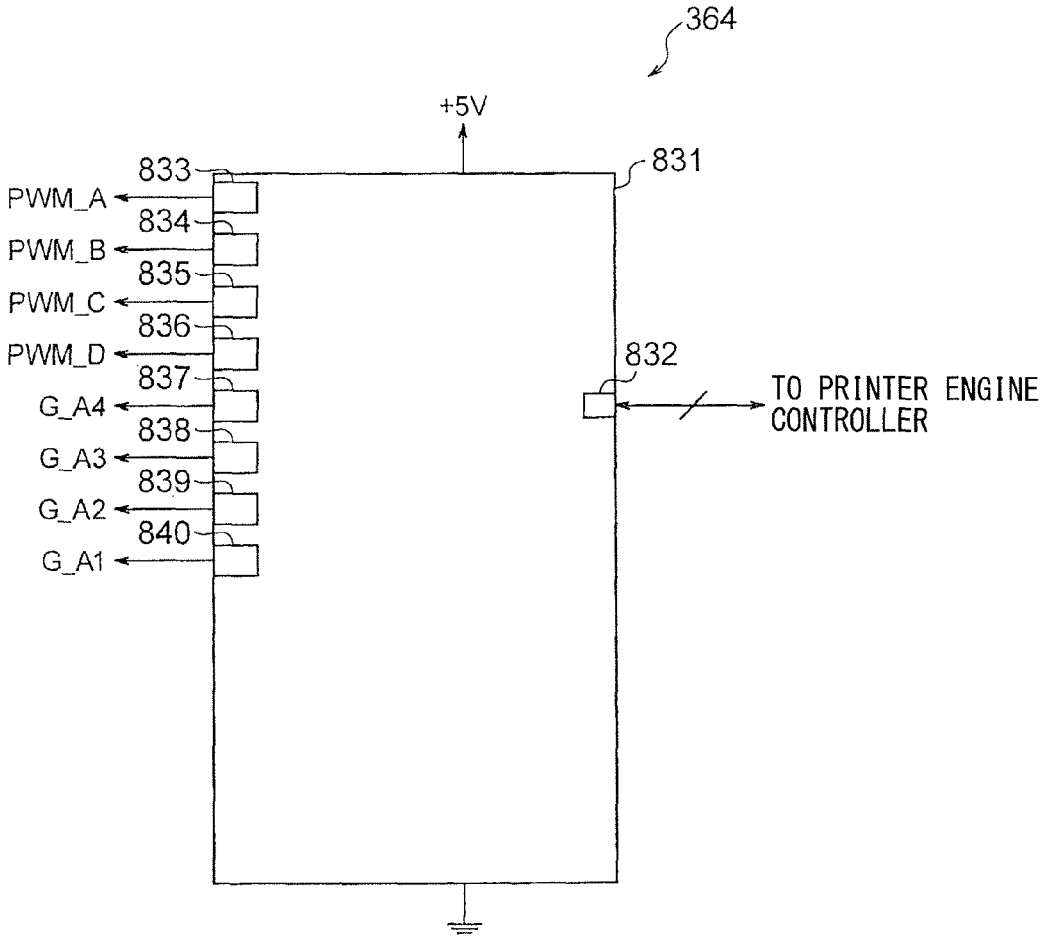
FIG. 22 is a circuit diagram illustrating an inverter controller of the DC-AC inverter in the third example embodiment.

FIG. 22 is a circuit diagram illustrating the inverter controller 364 of the DC-AC inverter 362.

The inverter controller 364 may be configured by a logic circuit 831 such as, but not limited to, a gate array. A reference numeral 832 may denote a communication interface for performing communication with the printer engine controller 343. Reference numerals 833, 834, 835, 836, 837, 838, 839, and 840 each may denote a PWM output terminal.

[Operation]

Referring to FIG. 19, the low-voltage power supply 360 may receive a supply of the electric power from the commercial power supplies CPA and CPB, and may perform switching of the alternating-current voltage, having been subjected to half-wave rectification by one of the power factor correction circuits 161, to step up the half-wave rectified alternating-current voltage. The stepped up voltage may be supplied to the downstream DC-AC inverter 362 at an output of the DC 390 V. In the present example embodiment, the power factor correction circuit 161 and the DC-DC converter 166 may perform switching of the direct-current voltage of DC 390 V, and output DC 24 V and DC 5 V following a step down operation performed by the transformer in which a primary side and a secondary side are isolated from each other. The DC voltages of 5 V and 24 V outputted from the DC-DC converter 166 may respectively be supplied to logic systems of the printer engine controller 343, etc. and to drive systems of the hopping motor 151, etc. The 5 V DC voltage may be converted on an as-needed basis into any other voltage, such as 3.3 V, required in each substrate. The DC 24 V and the DC 5 V may also be supplied to the DC-AC inverter 362 and the power factor correction circuit 161.

The DC-AC inverter 362 may have one output, and output the alternating-current voltage to the heaters 332 via the respective switches 367. The DC-AC inverter 362 may perform switching of the DC 390 V outputted from the power factor correction circuit 161 and smoothing of the thus-obtained output by means of an LC filter to output the alternating-current voltage having the variable output RMS value. Thus-outputted alternating-current voltage may be turned on and off by each of the switches 367 each configured by the triac serving as an AC switching device. The alternating-current voltages turned on and off by the corresponding switches 367 may be supplied to the respective heaters 332. The RMS value of the alternating current voltage and turning on and off of the inverter output may be controlled in accordance with signals supplied from the printer engine controller 343. The printer engine controller 343 may variably changes the inverter output to be applied to the heaters 332, based on the temperatures detected by the thermistor 331 and an operation state of the image forming apparatus 300. The printer engine controller 343 may also perform selection of the heaters 332 to be turned on in accordance with the widths of the print media of the image forming apparatus 300.

FIG. 20 schematically illustrates the heaters 332.

The alternating-current voltage may be applied to the heater 332D having the heat generation length L34 that may correspond to the width of the medium having the size of A1 to perform heating of the heater 332D, when the medium of A1, which may be, without limitation, the maximum size of the medium supported by the image forming apparatus 300, is conveyed.

When the medium having the size of A2 is fed longitudinally, the alternating-current voltage may be applied to the heater 332C that may correspond to the width of the medium having the size of A2 to perform heating of the heater 332C.

When the medium having the size of A3 is fed longitudinally, the alternating current may be applied to the heater 332B that may correspond to the width of the medium having the size of A3 to perform heating of the heater 332B.

When the medium having the size of A4 is fed longitudinally, the alternating current may be applied to the heater 332A that may correspond to the width of the medium having the size of A4 to perform heating of the heater 332A.

Among the heaters 332, one or two heaters 332 may be selectively turned on. Hence, even when an upper limit of the output of the DC-AC inverter 362 is 1400 W without limitation, the heaters 332 may be so controlled as to fall within a range of the upper limit of the output derived from the DC-AC inverter 362.

FIG. 21 is a circuit diagram of the switching section 363 of the DC-AC inverter 362 in the present example embodiment.

The switching section 363 may receive the signals from the inverter controller 364, and perform the switching of each of the IGBTs 915, 919, 928, and 932 to cause the DC 390 V to be switched, obtaining the alternating-current output.

The IGBTs 915, 919, 928, and 932 each may be any other device, non-limiting examples of which may include the Si-FET, the SiC-FET, and the GaN-FET.

In performing switching, a pair of high-side and low-side IGBTs 915 and 919 and a pair of high-side and low-side IGBTs 928 and 932 may each receive the signals that are substantially inverted from each other to prevent flowing of the flow-through current resulting from simultaneous turning-on of the high-side and the low-side IGBTs of any of such pairs. Also, the dead time of 1 (one) microsecond may be provided as the time period during which both the high-side and the low-side IGBTs as a pair are turned off, to prevent the occurrence of the time period in which both the high-side and the low-side IGBTs are turned on together by a delay in the turning-off period when the signals supplied to each of the pairs are the pure inverted signals. In the present example embodiment, the dead time is 1 μsec, although the dead time may be the time period set on an as-needed basis based on used devices and switching frequencies and hence the dead time is not limited to 1 μsec.

The pair of high-side and low-side IGBTs 928 and 932 may obtain an inverter output in combination with the pair of high-side and low-side IGBTs 915 and 919. Upon turning off the output, each of the pairs of high-side and low-side IGBTs may be supplied with signals same as those supplied to the pair of high-side and low-side IGBTs 928 and 932. In the present example embodiment, the pair of IGBTs 928 and 932 may supply the switching outputs of the +390 V and 0 V to a connection point of an emitter of the IGBT 928 and a collector of the IGBT 932 at 50 Hz. The frequency of 50 Hz may be an output frequency of the DC-AC inverter 362. In the present example embodiment, the output frequency is set to 50 Hz, although any frequency may be set. The remaining IGBTs 915 and 919 may perform the switching in response to the output of the DC-AC inverter 362. The pair of IGBTs 915 and 919 in combination with the pair of IGBTs 928 and 932 may generate the inverter output, and bring the triacs 950, 960, 970, and 980 into electric conduction to cause the currents to flow to the heaters 332 each serving as a load. The pair of high-side and low-side IGBTs 915 and 919 may be turned on at its exclusive timing. The voltages following the switching may be subjected to the removal of the high-frequency component present in the switching frequency components by the LC filter configured by the inductor 948 and the capacitor 949. The voltages following the removal of the high-frequency component may be supplied to the heaters 332 as sine wave outputs at 50 Hz through the respective triacs 950, 960, 970, and 980.

The photo couplers 907, 908, 909, and 910 each may be a gate driver IC insulated by a photo coupler. A non-limiting example of such a gate driver IC may be a TLP251 available from Toshiba Corporation located in Minato-ku, Tokyo, Japan. The photo couplers 907, 908, 909, and 910 may receive a supply of electric power from the DC 24 V power supply input sections 901, 904, and 921. These three side-by-side DC 24 V power supply input sections 901, 904, and 921 each may be the power supply illustrated in FIG. 6. The DC 24 V power supply input section 904 may be the DC 24 V power supply input section 512 as illustrated in FIG. 5, achieving sharing of a power supply. The remaining two DC 24 V power supply input sections 901 and 921 each may be an insulated power supply for a high-side drive circuit and thus each may require insulation. The insulated power supply of the gate drive circuit may be any of various insulated power supplies and is not limited to a system employed in the present example embodiment. On the primary side of each of the photo couplers 907, 908, 909, and 910, the N-channel FETs 903, 906, 923, and 925 may be subjected to switching by the PWM signals supplied from the inverter controller 364 to cause currents to flow to primary side light-emitting diodes of the respective photo couples 907, 908, 909, and 910, thereby driving the gate drive circuit located on the secondary side.

FIG. 22 is a block diagram of the inverter controller 364 that may output the PWM signals.

The inverter controller 364 may be achieved by the ASIC.

Based on the signals sent from the printer engine controller 343, the PWM output terminal 833 may output the PWM_A signal, the PWM output terminal 834 may output the PWM_B signal, the PWM output terminal 835 may output the PWM_C signal, and the PWM output terminal 836 may output the PWM_D signal. Further, based on the signals sent from the printer engine controller 343, the PWM output terminal 837 may output a G_A4 signal, the PWM output terminal 838 may output a G_A3 signal, the PWM output terminal 839 may output a G_A2 signal, and the PWM output terminal 840 may output a G_A1 signal. The printer engine controller 343 may output, for example but not limited to, a signal indicating starting of application of the voltage to each heater 332, a signal indicating increasing of the voltage applied to each heater 332, or a signal indicating decreasing of the voltage applied to each heater 332. The waveform memory 365 may store the pieces of information on waveforms indicating the duty ratios, corresponding to the predetermined number of respective voltages ranging from the minimum output voltage to the maximum output voltage to be applied to each heater 332, of the PWM_A signal, the PWM_B signal, the PWM_E signal, and the PWM_F signal. The inverter controller 364 may determine a waveform of the PWM_A signal, the PWM_B signal, the PWM_E signal, or the PWM_F signal and output the PWM signal having the determined waveform from the corresponding PWM output terminal, based on the signals sent from the printer engine controller 343 and on the pieces of waveform information stored in the waveform memory 365. Note that the ASIC is provided on the inverter side in the present example embodiment; however, a configuration may alternatively be employed in which the PWM signals are directly outputted from a large-scale integrated circuit of the printer engine controller 343.

The G_A1 signal, the G_A2 signal, the G_A3 signal, and the G_A4 signal may be signals to be outputted to the respective photo triacs 954, 964, 974, and 984 upon outputting gate pulses for turning on the respective triacs 950, 960, 970, and 980 provided in the switches 367. The inverter controller 364 may vary output timing of any of the G_A1 signal, the G_A2 signal, the G_A3 signal, and the G_A4 signal to increase or decrease the voltage applied to each heater 332, upon the output of the signal indicating increasing of the voltage applied to each heater 332, or the signal indicating decreasing of the voltage applied to each heater 332. In other words, the gate pulses in synchronization with the cycle of the output derived from the DC-AC inverter 362 may be outputted in accordance with the signals sent from the printer engine controller 343.

FIGS. 23A to 23D each schematically illustrate a waveform of the voltage outputted from the DC-AC inverter 362.

Figures 23A, 23B, 23C, 23D:
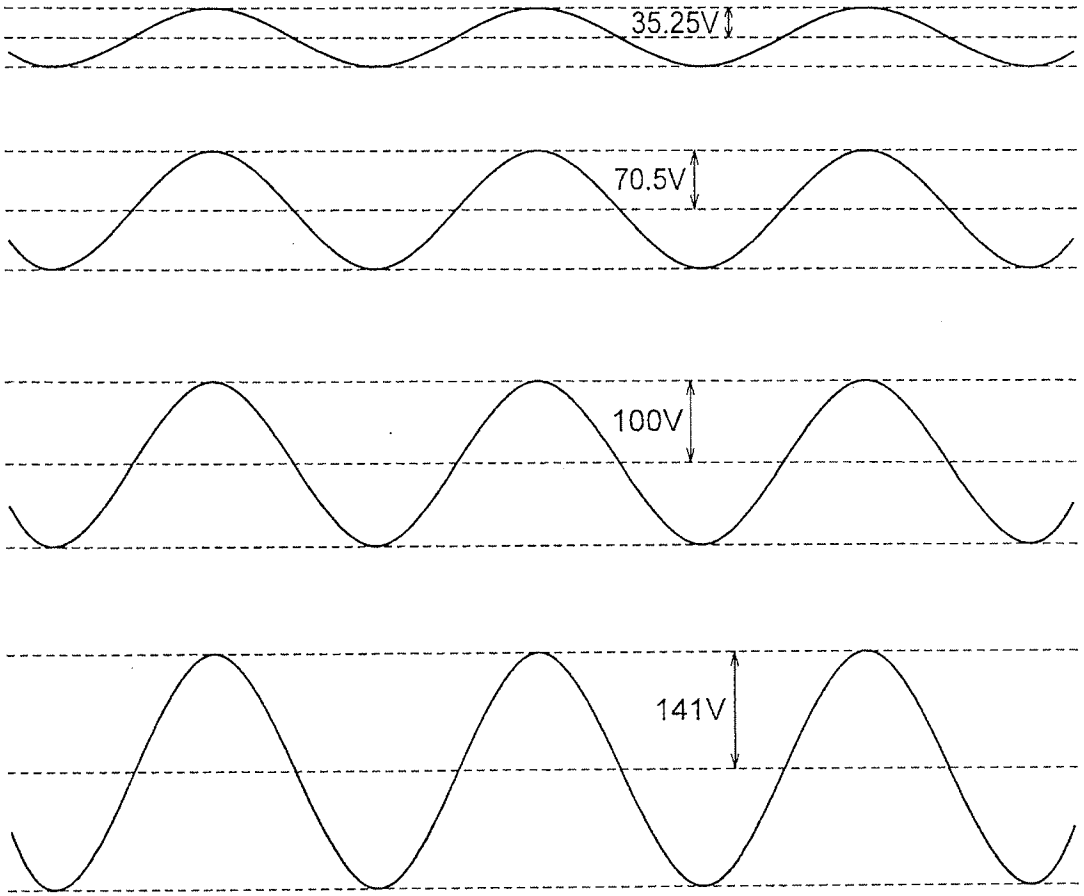
FIGS. 23A to 23D each schematically illustrate a waveform of a voltage outputted from the DC-AC inverter in the third example embodiment.

FIG. 23D illustrates the waveform where an AC output RMS value is AC 100 V with a peak of 141 V. FIG. 23C illustrates the waveform where the RMS value is AC 70 V. FIG. 23B illustrates the waveform where the RMS value is AC 50 V. FIG. 23A illustrates the waveform where the RMS value is AC 25 V.

The inverter controller 364 may control the switching section 363 to cause the frequency of the AC output to be constant, and variably change the amplitude to control the heat generation of the heaters 332. The DC-AC inverter 364 may so perform the control as to allow the AC voltage to be increased gradually from a low voltage upon performing wake-up of the heaters 332, from the viewpoint of the large inrush current resulting from the low resistance value upon initiation of electric conduction of the heaters 332 not warmed up. The heaters 332 each may be a halogen heater. The inverter controller 364 may perform the wake-up of the heaters 332 upon receiving from the printer engine controller 343 of the instructions that indicate starting of the application of the voltage to each heater 332. Further, the inverter controller 364 may so control the switching section 363 as to cause the waveforms to be varied gradually from the waveform illustrated in FIG. 23A to the waveform illustrated in FIG. 23D, for example. Such a control may be based on a similar idea to an existing phase angle control, i.e., a control of performing turning-on at 180 degrees entirely in the existing phase angle control may be equivalent to the inverter output of AC 100 V from the DC-AC inverter 362 in the present example embodiment. Similarly, a control of performing turning-on at 126 degrees of the phase angle in the existing phase angle control may be equivalent to the output of AC 70 V from the DC-AC inverter 362 in the present example embodiment. A control of performing turning-on at 90 degrees of the phase angle in the existing phase angle control may be equivalent to the output of AC 50 V, and a control of performing turning-on at 45 degrees of the phase angle in the existing phase angle control may be equivalent to the output of AC 25 V from the DC-AC inverter 362 in the present example embodiment. Although the controls may not be equivalent to each other in an actual circuit operation, the operation is performable easily based on correction that may be determined from experiments, calculation, or the like on an as-needed basis. In the following, a description is given of a method of variably changing a sine wave voltage.

The inverter controller 364 may vary the output timing of any of the G_A1 signal, the G_A2 signal, the G_A3 signal, and the G_A4 signal to vary the voltage applied to each heater 332, upon receiving from the printer engine controller 343 of the signal indicating increasing of the voltage applied to each heater 332, or the signal indicating decreasing of the voltage applied to each heater 332.

Figure 24:
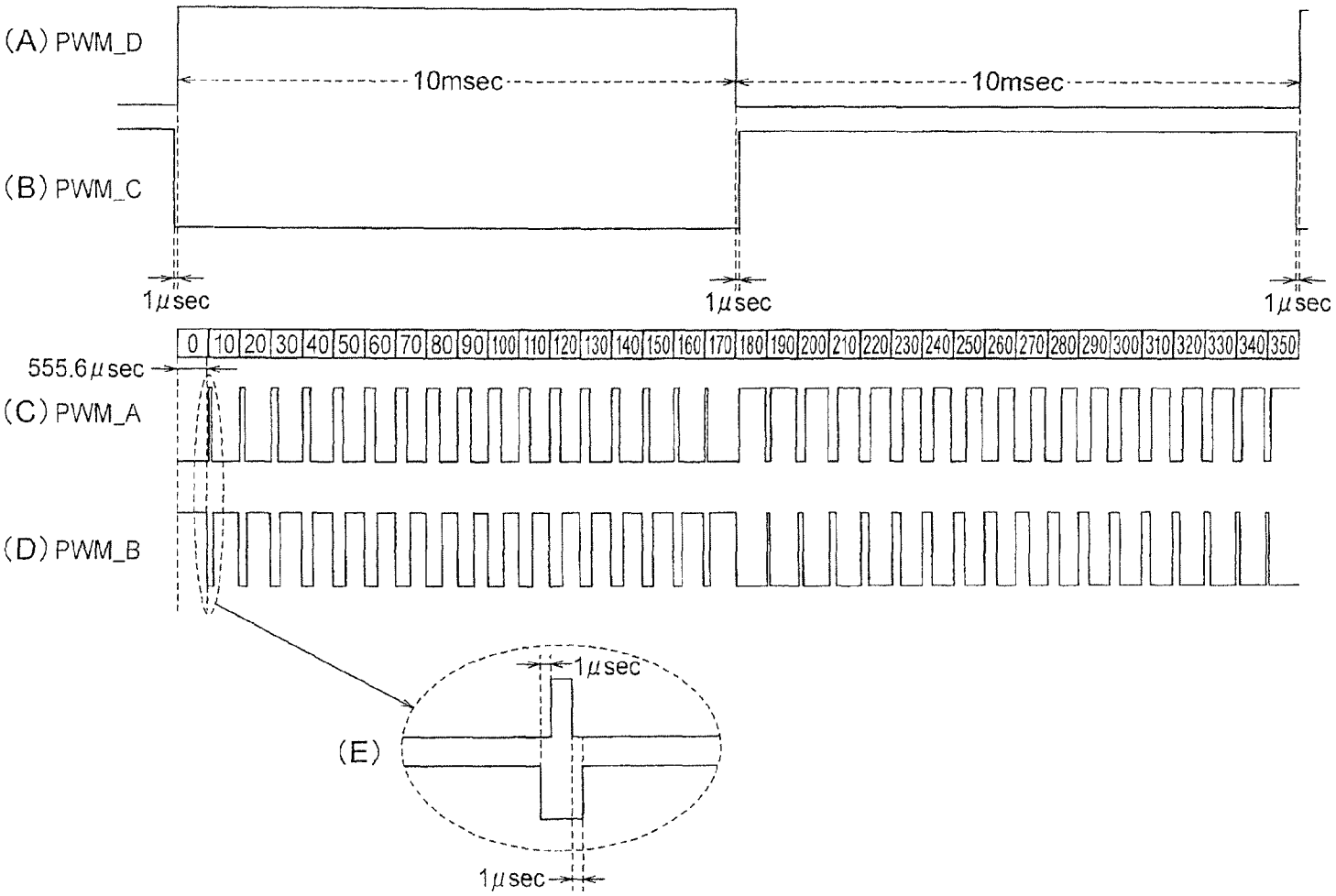
FIG. 24 is a schematic timing chart of PWM signals to be outputted from the inverter controller in the third example embodiment.

FIG. 24 is a schematic timing chart of the PWM signals to be outputted from the inverter controller 364.

Parts (A) to (E) of FIG. 24 illustrate waveforms of the PWM signals for obtaining a sine wave inverter output.

Referring to Parts (A) and (B) of FIG. 24, the PWM_D signal and the PWM_C signal that may determine an output frequency each may have a 50 Hz rectangular wave.

Referring to Parts (C) and (D) of FIG. 24, the PWM_A signal and the PWM_B signal that may determine the amplitude of the output voltage each may have a frequency higher than 50 Hz. In FIG. 24, the PWM_A signal and the PWM_B signal are illustrated as having a frequency of 1.8 kHz (with a cycle of 555.6 microseconds) for purpose of simplicity in illustration. In practice, it is preferable that the PWM_A signal and the PWM_B signal each have a frequency of 20 kHz that exceeds an audible range or higher. However, a loss may increase with an increase in frequency; hence, an optimal value may be determined for the frequency of each of the PWM_A signal and the PWM_B signal, based on selected devices and outputs. A description is given of the present example embodiment where the PWM_A signal and the PWM_B signal each have a frequency of 1.8 kHz in FIG. 24; however, a supplemental description is also given of the present example embodiment where the PWM_A signal and the PWM_B signal each have a frequency of 20 kHz. In the present example embodiment, the IGBTs 915, 919, 928, and 932 are used for the switching section 363 and hence the frequency of 20 kHz may be set. A frequency well higher than 20 kHz is selectable in one embodiment where devices such as, but not limited to, GaN-FETs are used.

The rectangular waveforms to be outputted to the pair of high-side and low-side IGBTs 915 and 919 may be provided with the dead time of 1 (one) microsecond as illustrated in Part (E) of FIG. 24. The dead time may be constant irrespective of the switching frequency. As illustrated in a table of FIG. 25, the duty ratios of the respective PWM signals may be determined by division of one cycle of a sine wave into 36 sections and use of a SIN function. In FIGS. 24 and 25, the PWM_A signal and the PWM_B signal are illustrated as having the frequency of 1.8 kHz. In the frequency of 20 kHz, a half cycle is 10 milliseconds and the number of cycles is 200 cycles. Hence, values determined by the foregoing Expression (1) may be stored as a table to determine the duty ratios.

The SIN value determined by the Expression (1) may be the duty ratio upon the generation of the sine wave having the peak of 390 V. Thus, the SIN value may be multiplied by a coefficient to allow a necessary voltage to be obtained. For example, the SIN value may be multiplied by 0.362 (=141÷390) in a case of outputting AC 100 V. This is one of the values listed in the column "Duty" in the table illustrated in FIG. 11. The values listed in the column "Duty" may be stored as a table, or may be determined by calculation on an as-needed basis.

The Expression (1) may be used in the case of 20 kHz. In the schematic diagram illustrated in FIG. 10, the foregoing Expression (2) may be used to allow the SIN value to be 0.362 at a peak.

Note that an influence of a distortion on the output may be negligible in the sine wave to be applied to each heater 332. Hence, the number of effective digits for the values in the table, the number of bits used for the calculation, etc., may be reduced on an as-needed basis depending on implementation, without raising any problem.

Figure 27:
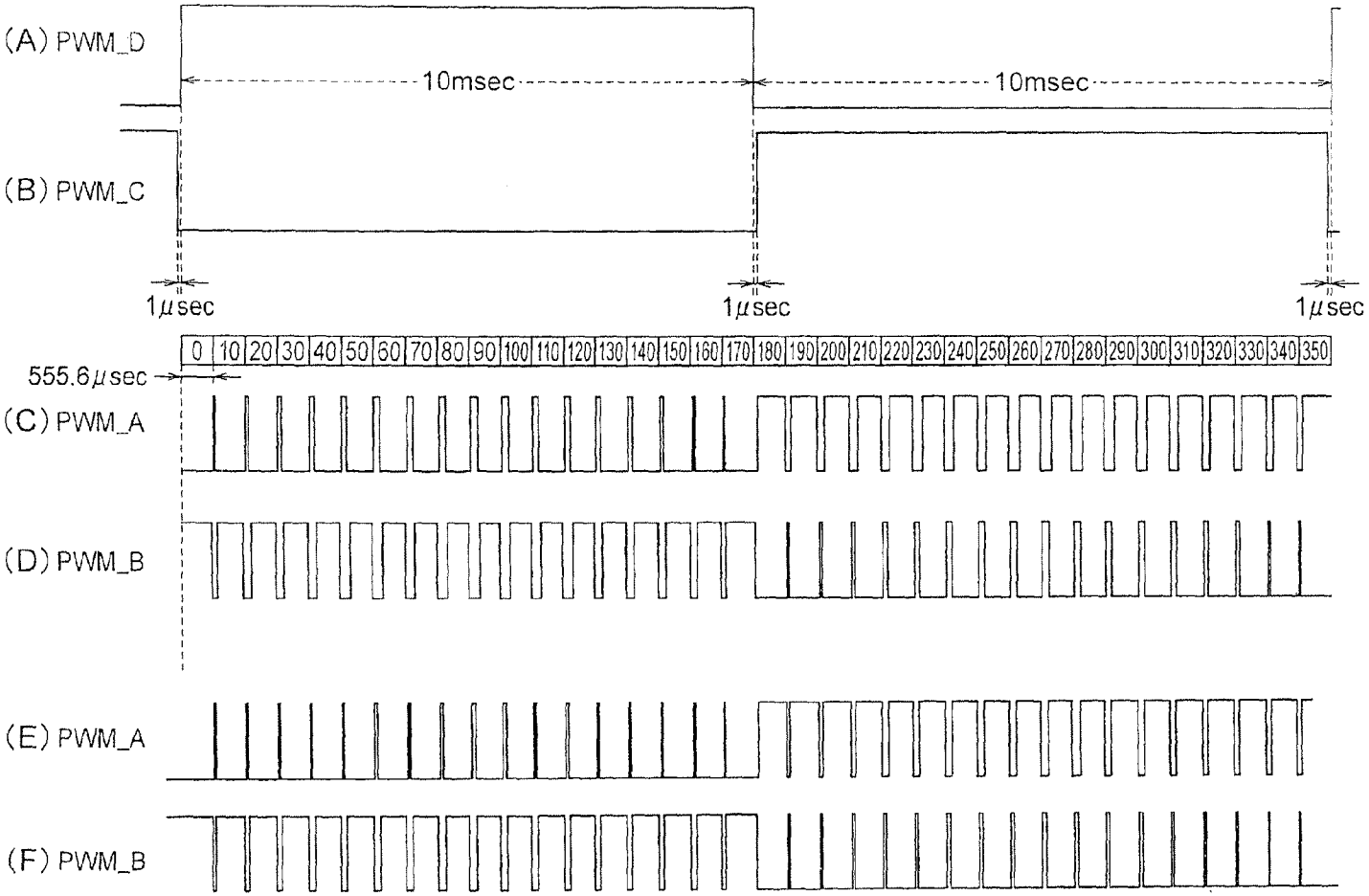
FIG. 27 illustrates duty ratios and timing in an example of AC 50 V (a DC peak of 70.5 V) and an example of AC 25 V (a DC peak of 35.25 V) in the third example embodiment.

A table of FIG. 26 and a schematic drawing of FIG. 27 respectively illustrate duty ratios and timing in an example of AC 50 V (a DC peak of 70.5 V) and an example of AC 25 V (a DC peak of 35.25 V). The PWM_A signal and the PWM_B signal each may correspond to an output waveform of AC 50 V, and the PWM_E signal and the PWM_F signal each may correspond to an output waveform of AC 25 V.

Figure 28:
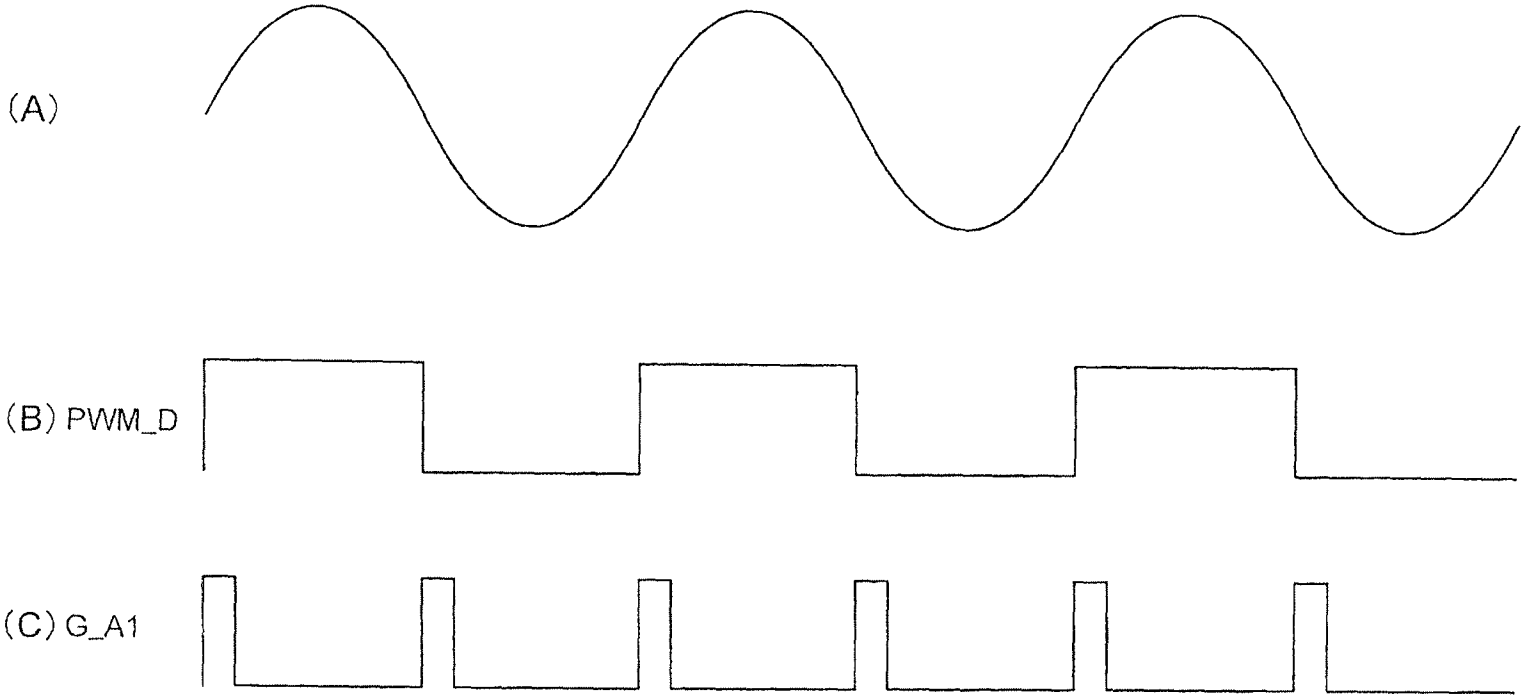
FIG. 28 schematically illustrates a gate pulse to be supplied to a triac and timing of a waveform of the PWM signal of the DC-AC inverter in the third example embodiment.

Parts (A) to (C) of FIG. 28 schematically illustrate a gate pulse to be supplied to the triac 980 and timing of a waveform of the PWM signal of the DC-AC inverter 362.

The triac 980 may receive the gate pulse upon turning on for each half cycle of the sine wave of the inverter output.

Also, the switch 367D may be so controlled that the gate pulse is outputted at the edge of the PWM_D signal or the PWM_C signal synchronized with the cycle of the inverter output. Thus, the switch 367D may be so controlled as to cause the heater 332 to be brought into electric conduction from a zero-cross point of the sine wave of the inverter output. This suppresses the inrush current applied to the heater 332D, and suppresses peak currents that flow to the IGBTs 915, 919, 928, and 932 structuring the DC-AC inverter 362. As can be appreciated from the foregoing description, a combination of the control of utilizing the zero-cross point and the control of gradually increasing the amplitude of the sine wave of the inverter output substantially suppresses the inrush current upon the initial stage of the power application performed on the heaters.

Figure 29:
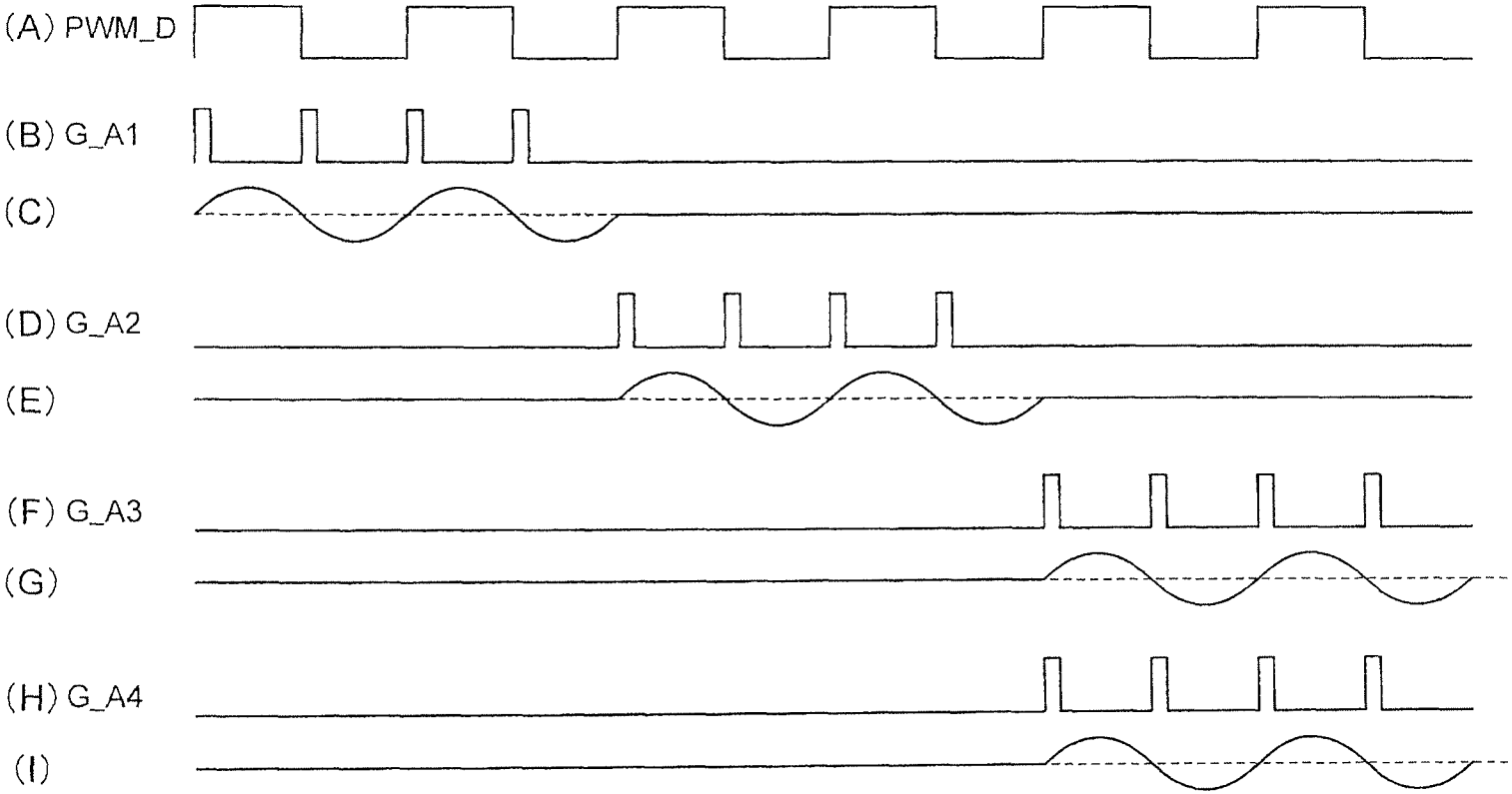
FIG. 29 schematically illustrates timing of gate pulses for respective triacs and waveforms of respective voltages to be applied to the heaters in the third example embodiment.

Parts (A) to (I) of FIG. 29 schematically illustrate timing of the gate pulses for the respective triacs 950, 960, 970, and 980 and waveforms of respective voltages to be applied to the heaters 332.

When performing the power application on the heater 332D that may have the output of 1400 W, the triacs 950, 960, and 970 other than the triac 980 for the heater 332D may be turned off such that the electric conduction is performed exclusively to the heater 332D. This allows a load of the inverter to be limited up to 1400 W. The G_A2 signal serving as the ON-signal of the heater 332C that may have the output of 1000 W may also be turned on exclusively. Further, the heater 332B that may have the output of 700 W and the heater 332A that may have the output of 500 W may be turned on together in response to the G_A3 signal and the G_A4 signal as illustrated in parts (F) to (I) of FIG. 29. Note that each timing here is for descriptive purpose only, and the triacs 950, 960, 970, and 980 may be selectively turned on by the printer engine controller 343 in accordance with a state of printing performed in the image forming apparatus 300.

The image forming apparatus 300 may cause the heaters 332 to be selectively turned on depending on the sizes of the media when the heaters 332 having the different heat generation lengths from each other are mounted as in the present example embodiment. The electric power derived from the commercial power supplies CPA and CPB is subjected to the conversion performed by the DC-AC inverter 362 to be applied to the heaters 332, in a state in which the power factor is made close to 1 (one) and the consumption current is made even irrespective of patterns in the turning on of the heaters 332. This prevents flicker or the like from occurring even when the voltage applied to each heater 332 is intermittent. Further, the plurality of triacs 950, 960, 970, and 980 may be used for a single channel of the inverter output to control the electric conduction performed on the plurality of heaters 332, eliminating the necessity of providing the multiple DC-AC inverters 362. In addition, the electric conduction of the triacs 950, 960, 970, and 980 may be performed at the zero-cross point of the output derived from the DC-AC inverter 362, making it possible to suppress a rapid variation in the inverter load.

Figure 30:
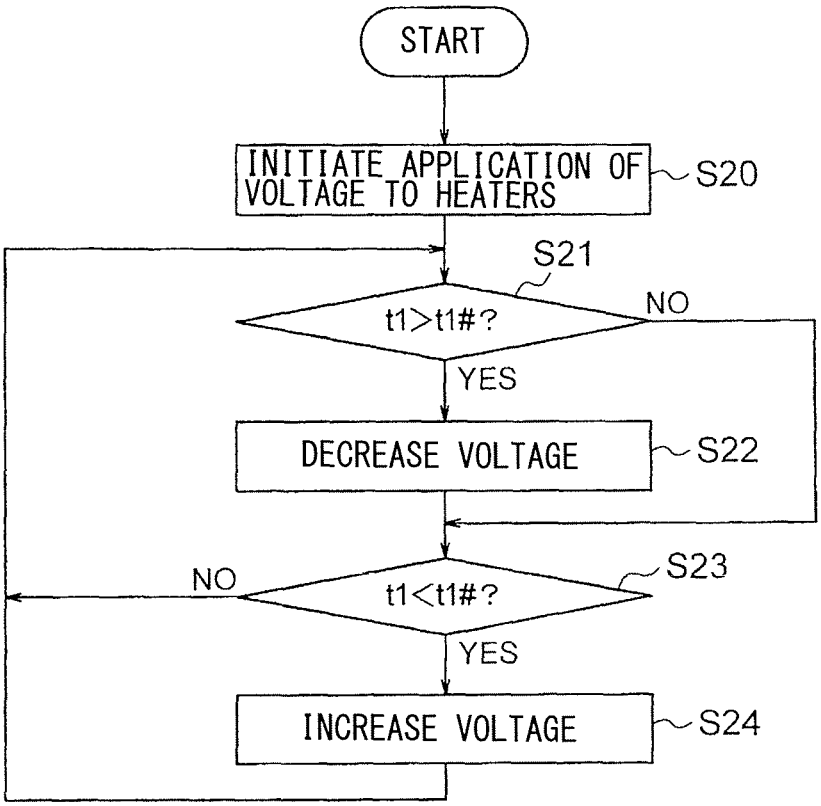
FIG. 30 is a flowchart illustrating a control of the DC-AC inverter performed by a printer engine controller in the third example embodiment.

FIG. 30 is a flowchart illustrating a control of the DC-AC inverter 362 performed by the printer engine controller 343 in the present example embodiment.

The flow illustrated in FIG. 30 illustrates an example of controlling a temperature of the heater 332D. The same also applies to a temperature control performed on other heaters 332A, 332B, and 332C.

The flow illustrated in FIG. 30 may be started when the power of the image forming apparatus 300 is turned on.

When the power of the image forming apparatus 300 is turned on, the printer engine controller 343 may instruct the inverter controller 364 to initiate the application of the voltage to the heaters 332 (step S20). Upon receiving of the instructions from the printer engine controller 343, the inverter controller 364 may so output the PWM signals from the PWM output terminals 833 and 834 as to cause the sine waves in the PWM signals to be gradually varied in order from the sine wave having the smallest amplitude to the sine wave having the largest amplitude, with reference to the pieces of waveform information stored in the waveform memory 365. The inverter controller 364 may cause the PWM signals, having the rectangular waves corresponding to the frequency of the alternating-current voltage to be outputted from the DC-AC inverter 362, to be outputted from the PWM output terminals 835 and 836.

Then, the printer engine controller 343 may make a determination as to whether a temperature t1 of the heater 332D is greater than a temperature t1#, based on the detection value derived from the thermistor 331 that measures the temperature of the heater 332D (step S21). The temperature t1# may be a predetermined target temperature. When the temperature t1 is determined as being greater than the temperature t1# as a threshold (Yes in S21), the process proceeds to step S22. When the temperature t1 is determined as being equal to or less than the temperature t1# as the threshold (No in S21), the process proceeds to step S23.

In the step S22, the printer engine controller 343 may instruct the inverter controller 364 to decrease the voltage applied to the heater 332D. Upon receiving of the instructions from the printer engine controller 343, the inverter controller 364 may reduce the number of times that the switch 367D is turned on per unit time to decrease the voltage applied to the heater 332D.

In the step S23, the printer engine controller 343 may make a determination as to whether the temperature t1 of the heater 332D is less than the predetermined target temperature t1#, based on the detection value derived from the thermistor 331 that measures the temperature of the heater 332D. When the temperature t1 is determined as being less than the temperature t1# as the threshold (Yes in S23), the process proceeds to step S24. When the temperature t1 is determined as being equal to or greater than the temperature t1# as the threshold (No in S23), the process returns to the step S21.

In the step S24, the printer engine controller 343 may instruct the inverter controller 364 to increase the voltage applied to the heater 332D. Upon receiving of the instructions from the printer engine controller 343, the inverter controller 364 may increase the number of times that the switch 367D is turned on per unit time to increase the voltage applied to the heater 332D.

As described in the foregoing, the image forming apparatus 300 according to the present example embodiment controls the electric power to be supplied to the heaters 332 by the DC-AC inverter 362 irrespective of the input voltages derived from the commercial power supplies CPA and CPB, and turns on the output of the DC-AC inverter 362 at its zero-cross point by the triacs 950, 960, 970, and 980. Hence, it is possible to reduce a level of the conduction noise, and to achieve an effect of eliminating the flicker or the like by virtue of the power factor correction circuit 161.

[Fourth Embodiment]

[Configuration]

Referring to FIG. 1, an image forming apparatus 400 according to a fourth example embodiment may have a configuration similar to the configuration of the image forming apparatus 300 according to the third example embodiment.

The image forming apparatus 400 according to the fourth example embodiment differs in configuration of a low-voltage power supply 460 from the image forming apparatus 300 according to the third example embodiment as illustrated in FIG. 2.

Referring to FIG. 19, the low-voltage power supply 460 in the fourth example embodiment may include the power factor correction circuit 161, a DC-AC inverter 462, and the DC-DC converter 166. The low-voltage power supply 460 in the fourth example embodiment differs in configuration of the DC-AC inverter 462 from the low-voltage power supply 460 in the third example embodiment.

The DC-AC inverter 462 in the fourth example embodiment may include the switching section 363, an inverter controller 464, a waveform memory 465, and the switches 367. The DC-AC inverter 462 in the fourth example embodiment differs in configurations of the inverter controller 464 and the waveform memory 465 from the DC-AC inverter 362 in the third example embodiment.

The inverter controller 464 may output the PWM signals to the switching section 363 in accordance with the signals supplied from the printer engine controller 343 to control the voltage to be outputted from the DC-AC inverter 462. The inverter controller 464 in the fourth example embodiment differs in output waveforms of the PWM signals from the inverter controller 364 in the third example embodiment.

The inverter controller 464 in the fourth example embodiment may also be configured by the logic circuit 831 as illustrated by way of example in FIG. 22.

The waveform memory 465 may store the pieces of waveform information that determine the waveforms of the PWM signals to be outputted from the inverter controller 464.

[Operation]

A description is given below of an operation performed in the fourth example embodiment. Note that an operation similar to that of the third example embodiment will not be described in detail.

Figure 31A:
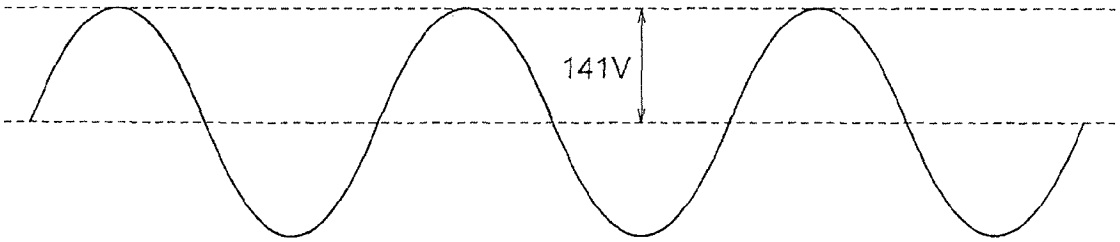
FIGS. 31A to 31C each schematically illustrate an output waveform derived from a DC-AC inverter in the fourth example embodiment.
Figure 31B:
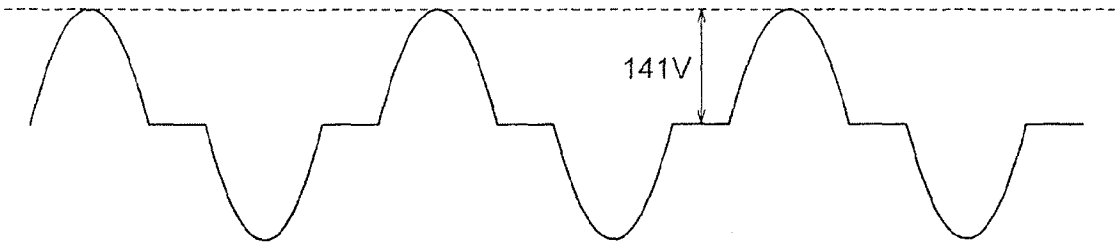
Figure 31C:
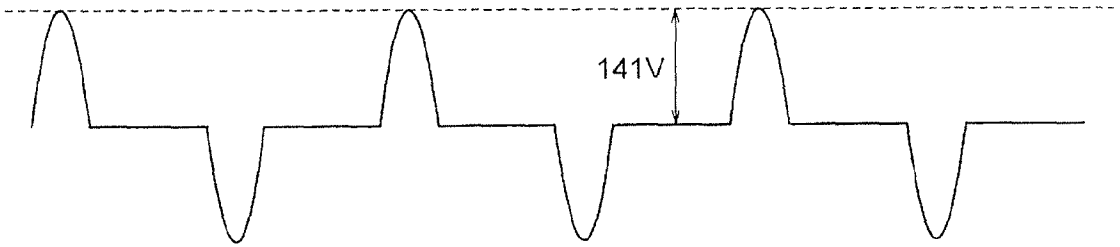

FIGS. 31A to 31C each schematically illustrate an output waveform derived from the DC-AC inverter 462 in the fourth example embodiment.

In the third example embodiment, the amplitude of the AC output voltage is variably changed to control the RMS value of the AC output voltage. In the fourth example embodiment, a peak of the amplitude is made constant, and an output width of a sine wave is varied to variably change the RMS value. In other words, an output frequency derived from the DC-AC inverter 462 is maintained at 50 Hz, and a waveform of a sine wave is set at a frequency higher than 50 Hz in a half cycle of the sine wave to lower the RMS value. Such a control may be achieved by changing the PWM signals to be outputted from the inverter controller 464, based on the duty ratios indicated by the pieces of waveform information stored in the waveform memory 465.

Figure 33:
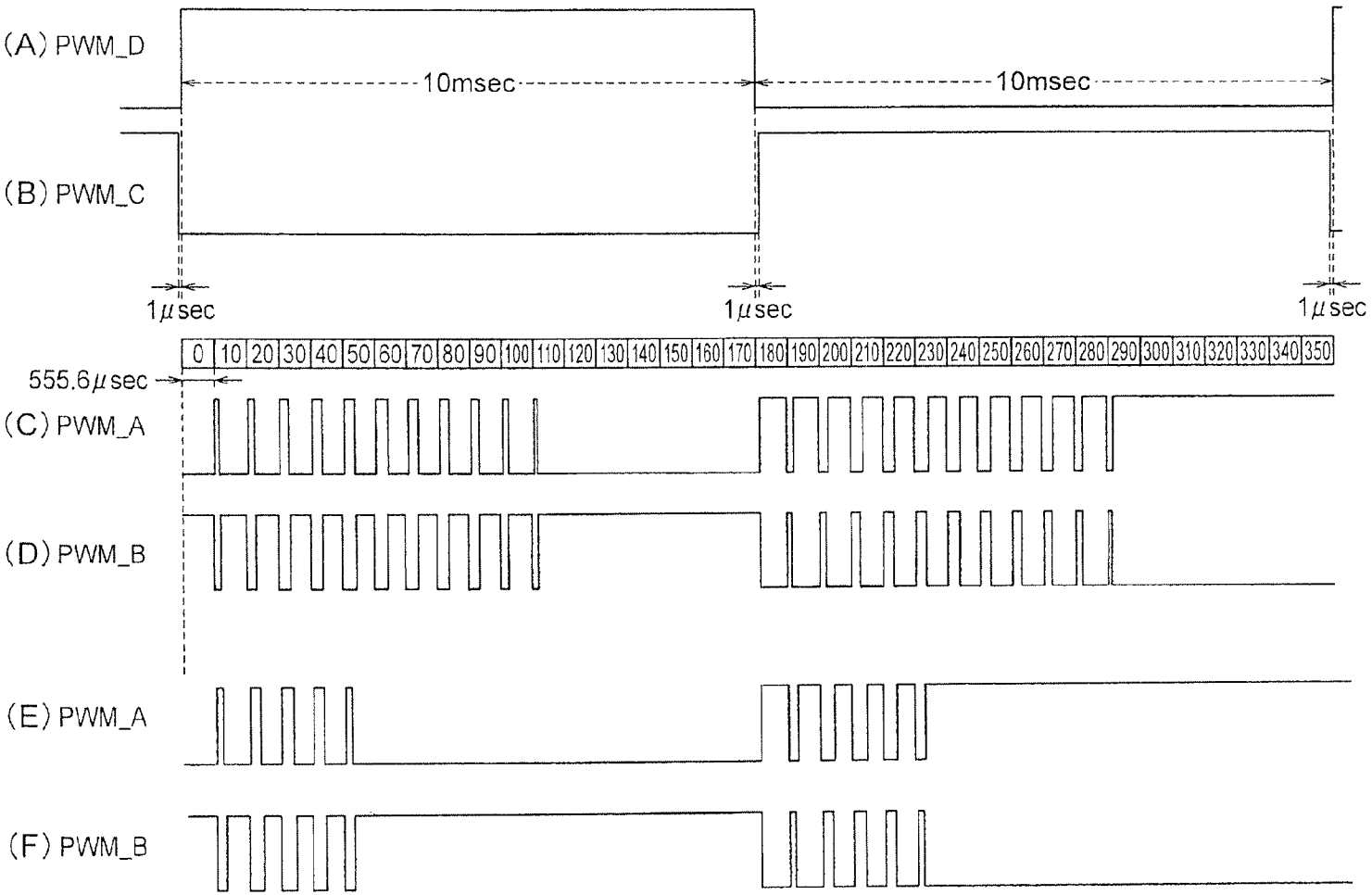
FIG. 33 is a schematic timing chart of the PWM signals to be outputted from the inverter controller in the fourth example embodiment.

FIG. 32 is a table illustrating an example of the duty ratios of the respective PWM signals to be outputted from the inverter controller 464. FIG. 33 is a schematic timing chart of the PWM signals to be outputted from the inverter controller 464. In FIGS. 32 and 33, the frequency of each of the PWM signals is set to 1.8 kHz as in the third example embodiment, although the frequency may be set to any other frequency such as, but not limited to, 20 kHz. FIG. 33 illustrates both of the cases where the output RMS values are AC 70 V and AC 30 V. The fourth example embodiment also makes it possible to variably change the AC RMS value in a range from AC 0 V to AC 100 V using a table or calculation.

The inrush current may also be large as in the third example embodiment upon the initial stage of the electric conduction performed on the heaters 332. Hence, the inverter controller 464 may so perform a control as to cause the voltage to be gradually higher from the voltage illustrated in FIG. 31C to the voltage illustrated in FIG. 31A, for example.

The control of variably changing the amplitude in the third example embodiment may also be performed only at the time of start-up. It is possible to achieve such a control easily by multiplying each of the duty ratios described in the above table by a predetermined value to control the amplitude.

Further, the control in the third example embodiment and the control in the fourth example embodiment may be combined with each other.

Although the control is so performed in the fourth example embodiment as to variably change the width of the sinusoidal voltage, it is also possible to variably change the applied RMS value by making the width of the sinusoidal voltage constant and variably changing a cycle of rectangular waves to be applied to the pair of IGBTs 928 and 932. Such a control makes it possible to achieve effects similar to those achieved by an existing frequency control, as well as to eliminate an influence of, such as, but not limited to, the flicker by virtue of the power factor correction circuit 161. The present example embodiment selectively turns on the plurality of triacs 950, 960, 970, and 980 to control the temperature of each of the heaters 332 as in the third example embodiment.

As described in the foregoing, the peak voltage is made even of the voltage to be outputted from the DC-AC inverter 462 to variably change the RMS value in the fourth example embodiment. Hence, it is possible to suppress or avoid a variation in characteristics resulting from the voltage applied to the heaters 332.

In an existing image forming apparatus, a voltage derived from a commercial power supply is applied directly to heaters. Hence, heaters corresponding to respective power supply voltages are necessary, preventing sharing of devices in an apparatus. Also, in an existing image forming apparatus, a fluctuation in voltage of the commercial power supply influences outputs of the heaters, which in turn influences quality of printing performed in the image forming apparatus when heat capacity of a fixing roller is decreased to address the recent trend of saving energy.

In contrast, according to the example embodiments described above, the voltage derived from any commercial power supply is converted into the direct current by the power factor correction circuit 161, and the thus-converted direct current is converted into the desired alternating current by any of the DC-AC inverters 162, 262, 362, and 462. Hence, it is possible to promote the sharing of devices and the energy saving.

Although the invention has been described in the foregoing by way of example with reference to the example embodiments, the invention is not limited thereto but may be modified in a wide variety of ways.

For example, although the foregoing first to fourth example embodiments have been described with reference to their respective color image forming apparatuses 100, 200, 300, and 400, any of the image forming apparatuses 100, 200, 300, and 400 may be a monochrome image forming apparatus.

Also, although the foregoing first to fourth example embodiments have been described with reference to their respective heaters that may be the halogen heaters, the heaters each may be any other heater such as, but not limited to, a ceramic heater.

Furthermore, the invention encompasses any possible combination of some or all of the various embodiments and the modification examples described herein and incorporated herein.

It is possible to achieve at least the following configurations from the above-described example embodiments of the invention.

(1) A heater controlling unit, including:

a power factor correction circuit configured to convert a first alternating-current voltage supplied from a power supply into a direct-current voltage;

an inverter configured to generate a second alternating-current voltage from the direct-current voltage converted by the power factor correction circuit; and a heater to which the second alternating-current voltage generated by the inverter is applied.

(2) The heater controlling unit according to (1), wherein the heater includes a plurality of heaters, the inverter includes output sections that are same in number as the heaters, the output sections are coupled to the respective heaters, and the inverter outputs the second alternating-current voltage from each of the output sections, the second alternating-current voltages outputted from the respective output sections having different root-mean-square values from each other.

(3) The heater controlling unit according to (2), wherein the inverter outputs, from the respective output sections, the second alternating-current voltages having same frequency as each other and different waveforms from each other.

(4) The heater controlling unit according to (3), wherein the inverter outputs, from the respective output sections, the second alternating-current voltages having different amplitudes from each other.

(5) The heater controlling unit according to (3), wherein the inverter outputs, from the respective output sections, the second alternating-current voltages each having a sinusoidal waveform in which a waveform in a half cycle is at a frequency different from the frequency of the second alternating-current voltage to be outputted.

(6) The heater controlling unit according to any one of (2) to (5), wherein the inverter includes a bridge circuit configured to perform switching of the direct-current voltage converted by the power factor correction circuit, and the bridge circuit includes a pair of switching devices configured to be switched based on a frequency of the second alternating-current voltages to be outputted from the inverter, and pairs of switching devices each configured to be switched based on a magnitude of the root-mean-square value of corresponding one of the second alternating-current voltages to be outputted from the inverter.

(7) The heater controlling unit according to (6), wherein the inverter staggers timing at which any of the pairs of switching devices are switched from timing at which any other pair of switching devices are switched to prevent timing at which any of the pairs of switching devices are brought into electric conduction from being coincident with timing at which any other pair of switching devices are brought into electric conduction.

(8) The heater controlling unit according to (7), wherein the direct-current voltage to be outputted from the power factor correction circuit is defined to prevent a value from exceeding one, the value being derived from addition of peak values of duty ratios for the switching of each of the pairs of switching devices.

(9) The heater controlling unit according to (1), wherein the heater includes a plurality of heaters, the inverter includes a single output section, and a plurality of switches each configured to turn on and off a supply of the second alternating-current voltage outputted from the inverter to each of the heaters, the heaters are coupled in parallel to the output section, and timing of turning on each of the switches is at a zero-cross point of the second alternating-current voltage outputted from the inverter.

(10) The heater controlling unit according to (9), wherein the second alternating-current voltage outputted from the inverter includes a plurality of second alternating-current voltages having same frequency as each other and different waveforms from each other, and the inverter outputs the second alternating-current voltages to cause a higher voltage to be outputted gradually upon wake-up of the heaters.

(11) The heater controlling unit according to (10), wherein the inverter varies amplitude of each of the second alternating-current voltages to be outputted.

(12) The heater controlling unit according to (10), wherein the inverter causes each of the second alternating-current voltages to be outputted to have a sinusoidal waveform in which a waveform in a half cycle is at a frequency different from the frequency of the second alternating-current voltage to be outputted.

(13) The heater controlling unit according to any one of (1) to (12), wherein the power supply includes a plurality of commercial power supplies, and the power factor correction circuit accepts the plurality of commercial power supplies.

(14) The heater controlling unit according to any one of (1) to (13), further including a converter configured to receive a supply of the direct-current voltage converted by the power factor correction circuit to output a converted direct-current voltage.

(15) An image forming apparatus, including:

an image forming unit configured to form a developer image on a medium; and a fixing unit configured to fix the developer image formed on the medium, the fixing unit including:

a power factor correction circuit configured to convert a first alternating-current voltage supplied from a power supply into a direct-current voltage;

an inverter configured to generate a second alternating-current voltage from the direct-current voltage converted by the power factor correction circuit; and a heater to which the second alternating-current voltage generated by the inverter is applied.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A heater controlling unit, comprising:

a power factor correction circuit configured to convert a first alternating-current voltage supplied from a power supply into a direct-current voltage;

an inverter configured to generate a second alternating-current voltage from the direct-current voltage converted by the power factor correction circuit; and a plurality of heaters to each of which the second alternating-current voltage generated by the inverter is applied, wherein the inverter includes output sections that are the same in number as the heaters, the output sections are coupled to the respective heaters, and the inverter outputs the second alternatin&current voltage from each of the output sections, the second alternating-current voltages outputted from the respective output sections having different root-mean-square values from each other.

2. The heater controlling unit according to claim 1, wherein the inverter outputs, from the respective output sections, the second alternating-current voltages having the same frequency as each other and different waveforms from each other.

3. The heater controlling unit according to claim 2, wherein the inverter outputs, from the respective output sections, the second alternating-current voltages having different amplitudes from each other.

4. The heater controlling unit according to claim 2, wherein the inverter outputs, from the respective output sections, the second alternating-current voltages each having a sinusoidal waveform in which a waveform in a half cycle is at a frequency different from the frequency of the second alternating-current voltage to be outputted.

5. The heater controlling unit according to claim 1, wherein the inverter includes a bridge circuit configured to perform switching of the direct-current voltage converted by the power factor correction circuit, and the bridge circuit includes a pair of switching devices configured to be switched based on a frequency of the second alternating-current voltages to be outputted from the inverter, and pairs of switching devices each configured to be switched based on a magnitude of the root-mean-square value of a corresponding one of the second alternating-current voltages to be outputted from the inverter.

6. The heater controlling unit according to claim 5, wherein the inverter staggers timing at which any of the pairs of switching devices are switched from timing at which any other pair of switching devices are switched to prevent timing at which any of the pairs of switching devices are brought into electric conduction from being coincident with timing at which any other pair of switching devices are brought into electric conduction.

7. The heater controlling unit according to claim 6, wherein the direct-current voltage to be outputted from the power factor correction circuit is defined to prevent a value from exceeding one, the value being derived from the addition of peak values of duty ratios for the switching of each of the pairs of switching devices.

8. The heater controlling unit according to claim 1, wherein the power supply comprises a plurality of commercial power supplies, and the power factor correction circuit accepts the plurality of commercial power supplies.

9. The heater controlling unit according to claim 1, further comprising a converter configured to receive a supply of the direct-current voltage converted by the power factor correction circuit to output a converted direct-current voltage.

10. The heater controlling unit according to claim 1, further comprising a filter coupled between an output of the inverter and the heaters, and configured to reduce a switching frequency component of the second alternating-current voltage outputted from the inverter.

11. The heater controlling unit according to claim 10, wherein the filter is an LC filter including an inductor and a capacitor, the inductor being coupled in series to the inverter and the capacitor being coupled to the heaters.

12. The heater controlling unit according to claim 10, wherein the filter reduces a high-frequency component that is used for switching of the inverter and has a frequency of 20 kHz or higher.

13. The heater controlling unit according to claim 1, wherein the power factor correction circuit includes a first node, a second node, and a capacitor, and outputs the direct-current voltage between the first node and the second node, the capacitor being provided between the first node and the second node, the inverter is coupled to the first node and the second node, and includes a bridge circuit, the bridge circuit has a pair of high-side and low-side switching devices, a first diode, and a second diode, the pair of high-side and low-side switching devices including a high-side switching device and a low-side switching device, the first diode being coupled in parallel to the high-side switching device, the second diode being coupled in parallel to the low-side switching device, the pair of high-side and low-side switching devices being coupled to the first node and the second node, the output sections include a third node and a fourth node, the inverter outputs the second alternating-current voltage to the third node and the fourth node by using the pair of high-side and low-side switching devices, and one or more of the heaters is coupled between the third node and the fourth node.

14. The heater controlling unit according to claim 13, further comprising a LC filter including an inductor and a capacitor and is configured to reduce a switching frequency component of the second alternating-current voltage outputted by the pair of high-side and low-side switching devices in the inverter, wherein the inductor is coupled in series to the inverter and the capacitor is coupled to the heaters, and the third node and the fourth node are coupled downstream of the filter.

15. A heater controlling unit, comprising:

a power factor correction circuit configured to convert a first alternating-current voltage supplied from a power supply into a direct-current voltage;

an inverter configured to generate a second alternating-current voltage from the direct-current voltage converted by the power factor correction circuit; and a plurality of heaters to each of which the second alternating-current voltage generated by the inverter is applied, wherein the inverter includes a single output section, and a plurality of switches each configured to turn on and off a supply of the second alternating-current voltage outputted from the inverter to each of the heaters, the heaters are coupled in parallel to the output section, and timing of turning on of each of the switches is based on a signal that is synchronized with a zero-cross point of the second alternating-current voltage outputted from the inverter.

16. The heater controlling unit according to claim 15, wherein the second alternating-current voltage outputted from the inverter comprises a plurality of second alternating-current voltages having the same frequency as each other and different waveforms from each other, and the inverter outputs the second alternating-current voltages to cause a higher voltage to be outputted gradually upon wake-up of the heaters.

17. The heater controlling unit according to claim 16, wherein the inverter varies the amplitude of each of the second alternating-current voltages to be outputted.

18. The heater controlling unit according to claim 16, wherein the inverter causes each of the second alternating-current voltages to be outputted to have a sinusoidal waveform in which a waveform in a half cycle is at a frequency different from the frequency of the second alternating-current voltage to be outputted.

19. An image forming apparatus, comprising the heater controlling unit according to claim 15.

20. The heater controlling unit according to claim 15, wherein the timing of turning on controls one or more of the switches and thereby starts outputting of the second alternating-current voltage to one or more of the heaters, and is controlled based on a pulse width modulation signal that is synchronized with a cycle of a sine wave of the second alternating-current voltage outputted by the inverter.

21. An image forming apparatus, comprising:

an image forming unit configured to form a developer image on a medium; and a fixing unit configured to fix the developer image formed on the medium, the fixing unit including:

a power factor correction circuit configured to convert a first alternating-current voltage supplied from a power supply into a direct-current voltage;

an inverter configured to generate a second alternating-current voltage from the direct-current voltage converted by the power factor correction circuit; and a plurality of heaters to each of which the second alternating-current voltage generated by the inverter is applied, wherein the inverter includes output sections that are the same in number as the heaters., the output sections are coupled to the respective heaters, and the inverter outputs the second alternating-current voltage from each of the output sections, the second alternating-current voltages outputted from the respective output sections having different root-mean-square values from each other.

* * * * *